United States Patent [19]

Takagi et al.

[11] Patent Number: 4,709,611

[45] Date of Patent: Dec. 1, 1987

[54] ELECTRONIC MUSICAL INSTRUMENT FOR GENERATING A NATURAL MUSICAL TONE

[75] Inventors: Yoshiyuki Takagi, Osaka; Tetsuhiko Kaneaki, Ashiya, both of Japan

[73] Assignee: Matsushita Electric Industrial Co., Ltd., Kadoma, Japan

[21] Appl. No.: 841,110

[22] Filed: Mar. 18, 1986

[30] Foreign Application Priority Data

Mar. 19, 1985 [JP] Japan ..... 60-53249
Apr. 20, 1985 [JP] Japan ..... 60-83621
Apr. 27, 1985 [JP] Japan ..... 60-89919

[51] Int. Cl.[4] ..... G10H 1/057; G10H 1/08; G10H 7/00

[52] U.S. Cl. ..... 84/1.22; 84/1.26; 84/1.13

[58] Field of Search ..... 84/1.11–1.13, 84/1.19–1.26

[56] References Cited

U.S. PATENT DOCUMENTS 4,383,462 5/1983 Nagai et al. ..... 84/1.26
4,442,745 4/1984 Gross et al. ..... 84/1.26 X
4,502,361 3/1985 Viitanen et al. ..... 84/1.26
4,520,708 6/1985 Wachi ..... 84/1.26
4,524,666 6/1985 Kato ..... 84/1.26 X
4,635,520 1/1987 Mitsumi ..... 84/1.26
4,638,710 1/1987 Kitamura et al. ..... 84/1.26

FOREIGN PATENT DOCUMENTS 52-107823 9/1977 Japan .

*Primary Examiner*—S. J. Witkowski
*Attorney, Agent, or Firm*—Wenderoth, Lind & Ponack

[57] ABSTRACT

An electronic musical instrument includes a first waveform memory for storing a waveform corresponding to an attack portion of a musical tone and one period of a steady waveform produced after the attack, a second waveform memory for storing one period of a waveform different from the contents of the first waveform memory, a waveform reader which reads out the first and second waveform from the first and second waveform memory, respectively, and an envelope generator which generates two separate envelope signals. The first waveform including the attack portion of the musical tone and the periodic second waveform are multiplied by the separate envelope signals, respectively, and then the products of the multiplication are added together. The sum of the products is provided as an output. Thus, the electronic musical instrument is capable of precisely simulating the attack portions of musical tones of a natural musical instrument and generating musical tone signals having a steady part vividly simulating the musical tones of the natural musical instrument.

5 Claims, 27 Drawing Figures

MASTER CLOCK
φ1
φ3
TIME SLOT
0
1
2
3
TIME SLOT
10 0 1 2 3 4 5 6 7 8 9 10 11 12 13 14 15 16 17 18 19 0
SHORT SEQUENCE
LONG SEQUENCE
CHANNEL
7 3 0 1 2 3 4 5 6 7 4 0 1 2 3 4 5 6 7 5
CHANNEL
3 ODD
3 3 3

ELECTRONIC MUSICAL INSTRUMENT FOR GENERATING A NATURAL MUSICAL TONE

BACKGROUND OF THE INVENTION

1. Field of the Invention

The present invention relates to an electronic musical instrument which generates musical tones through digital signal processing and more specifically, to an electronic musical instrument capable of simulating the musical tones of natural musical instruments such as pianos, flutes, horns, strings, etc.

2. Description of the Prior Art

In recent years, the introduction of digital signal processing technique into electronic musical instruments has enabled the generation of high-quality musical tones. Provisional Japanese Patent Publication (Kokai) No. 52-107823 discloses an advanced electronic musical instrument, the manner of operation of which will be described with reference to a block diagram shown in FIG. 15. When a key on a keyboard 300 is depressed, an R-number memory 301 generates frequency information (hereinafter referred to as "an R-number") corresponding to the depressed key. A gate 302 is controlled by a clock pulse $\phi$. An accumulator 303 adds the R-number repeatedly at every clock pulse $\phi$. Therefore, the output S of the accumulator increases at every clock pulse $\phi$ from $S=0, R, 2R, \ldots$, and after the output S has exceeded a constant N, a difference $S-N$ remains in the accumulator 303. A waveform memory I 310 and a waveform memory II 320 provides waveforms of two systems addressed by the output S of the accumulator 303. Therefore, when the addressable area of the waveform memory I 310 and the waveform memory II 320 is N, the frequency f of the output is:

$$f=R/N\times(\text{frequency of clock pulse } \phi) \quad (1)$$

Logarithmic waveforms log $W_1$ and log $W_2$ are stored beforehand in the waveform memory I 310 and the waveform memory II 320, respectively. A time function generator 330 generates a time function f(t). Indicated at 331 is a logarithmic converter (L/LG converter). An adder 311 adds: $a_1+a_2$ and a subtractor 321 subtracts $b_1-b_2$. Elements 312 and 322 are logarithmic/linear converters; (LG/L converters) element 341 is an adder, element 350 is an envelope generator, element 342 is a multiplier which multiplies the output of the adder 341 by the output of the envelope generator 350, element 343 is a D/A converter, element 344 is an amplifier and element 345 is a speaker. In operation, when the key is depressed, the time function generator 330 generates a time function f(t), and then the L/LG converter 331 converts the time function f(t) into log f(t). On the other hand, the waveform memory I 310 and the waveform memory II provide waveforms log $W_1$ and log $W_2$ of a frequency decided by Expression (1), respectively. Consequently, the adder 311, the subtractor 321, the LG/L converter 312 and the LG/L converter 322 provide log $W_1$+log f(t), log $W_2$−log f(t), $W_1\times f(t)$ and $W_2/f(t)$, respectively. Therefore, the adder 341 provides $W_1\times f(t)+W_2/f(t)$, and then this output of the adder 341 is multiplied by the envelope signal generated by the envelope generator 350 in the multiplier 342. The result of the multiplication is converted into a corresponding analog signal by the D/A converter 343 and the analog signal is amplified by the amplifier 344 to drive the speaker 345 to generate a corresponding musical tone.

Since the above-mentioned constitution is calculated only to vary the mixing ratio of two waveforms with time, this constitution is unable to simulate the subtle variation in tone during the initial rising period (usually called the "attack period") of each sound. The portion of a sound waveform during the attack period will hereinafter be referred to as the "attack portion".

SUMMARY OF THE INVENTION

Accordingly, it is an object of the present invention to provide an electronic musical instrument capable of simulating subtle variations of musical tones during each attack period and capable of generating natural (not electrical-tone-like) musical tones in the steady state.

In order to achieve the object of the invention, the present invention provides an electronic musical instrument comprising: a data bank for storing first waveform data corresponding to an attack portion of a musical tone, a second waveform data corresponding to one cycle waveform of a musical tone, a first parameter representing a characteristic of a first envelope representing a sound level variation of the first waveform data, and a second parameter representing a characteristic of a second envelope representing a sound level variation of the second waveform data; an envelope forming means which reads out the first parameter and the second parameter from the data bank and forms the first envelope and the second envelope; a data producing means which reads out the first waveform data sequentially from the data bank, waveform data of the last cycle of the first waveform being read out repeatedly, and multiplies the data read out from the data bank by the first envelope to produce first data, and at the same time reads out the second waveform data repeatedly from the data bank and multiplies the read-out second waveform data by the second envelope to produce second data; and musical tone data producing means which adds the first data and the second data to produce musical tone data.

In this electronic musical instrument, when each key of the keyboard is depressed, previously stored waveform data corresponding to the attack portion of a musical tone of a natural musical instrument is read out, two waveform data are respectively multiplied by envelopes, independent of each other, and the products of the multiplication are added together, so that the subtle variation in tone during each attack period can be reproduced. The multiplication of two waveform data by the indipendently provided envelopes prevents the reproduced tone in the steady state from becoming monotonous.

DESCRIPTION OF THE PREFERRED EMBODIMENTS

Figure 1A:
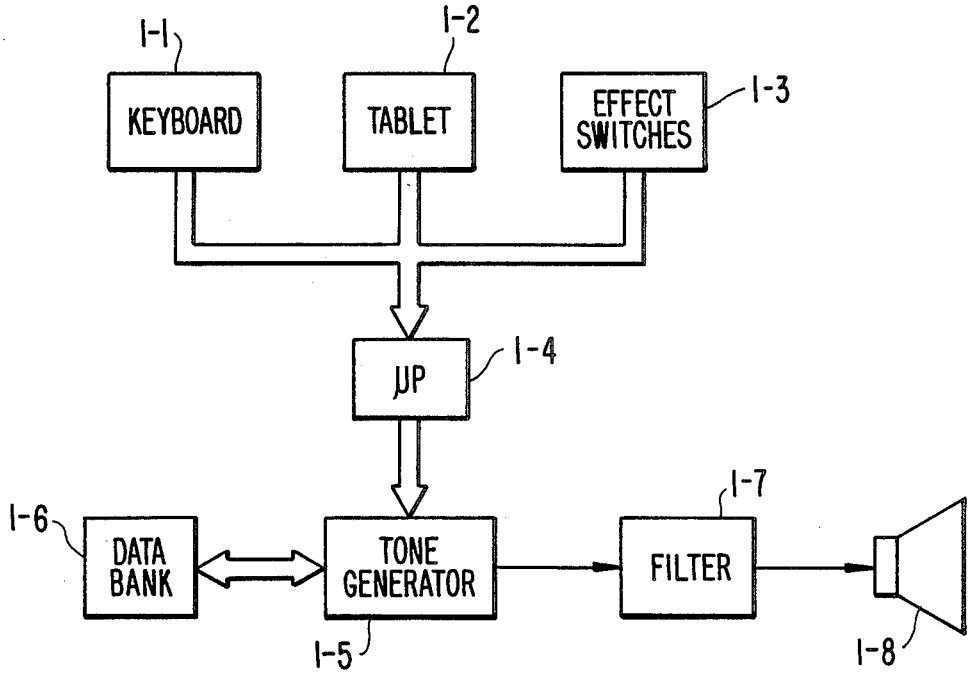
FIG. 1*a* is a block diagram of an electonic musical instrument, in a preferred embodiment, according to the present invention.

In FIG. 1*a* showing an electronic musical instrument according to the present invention, there are shown a keyboard 1-1, a tablet 1-2 which is, a control unit for instructing the selection of musical tone signals to be produced by the electronic musical instrument, effect switches 1-3 for controlling effects, such as vibrato and tremolo, to be imparted to musical tones, a microprocessor ($\mu$P) 1-4, such as an Intel 8049, a musical tone signal generating unit (tone generator) 1-5 which calculates waveforms and frequencies according to control signals given thereto by the microprocessor 1-4, a data bank 1-6 comprising a read only memory (ROM) for storing waveform data and envelope data to be used by the musical tone signal generating unit 1-5, a filter 1-7 for removing aliasing noise in the output musical sound signals of the musical tone signal generating unit 1-5, and a speaker 1-8.

In operation, the condition of the keyboard 1-1, the tablet 1-2 and the effect switches 1-3 is searched sequentially according to commands previously stored in the microprocessor 1-4. The microprocessor 1-4 provides an assignment signal to assign the code of a depressed key of the keyboard 1-1 to a plurality of channels of the musical tone signal generating unit 1-5 on the condition of the key and also provides control data corresponding to the condition of the tablet 1-2 and the effect switches 1-3. The musical tone signal generating unit 1-5 receives the assignment signal and other control signals provided by the microprocessor 1-4 into its internal registers, and then reads out necessary waveform data and envelope data from the data bank 1-6 according to the output signals of the microprocessor 1-4 to synthesize a musical tone signal. The musical tone signal synthesized by the musical tone signal generating unit 1-5 is given through the filter 1-7 to the speaker 1-8 to produce a corresponding musical tone.

Figure 1B:
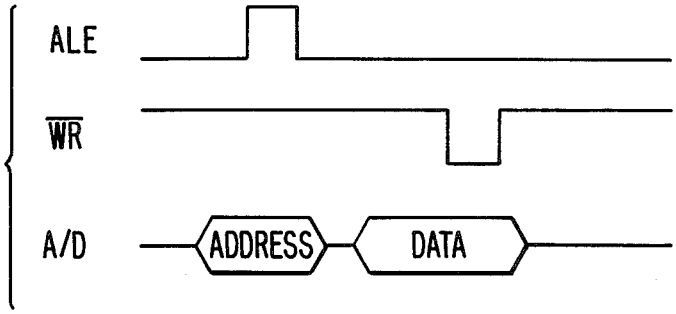
FIG. 1*b* is a time chart of data transfer operation of a microprocessor.

A timing chart of data transfer from the microprocessor 1-4 to the musical tone signal generating unit 1-5 is shown in FIG. 1*b* and the contents of the data given by the microprocessor 1-4 to the musical tone signal generating unit 1-5 are tabulated in Table 1. In Table 1, note octave data NOD includes note data, octave data OCT and key-on data Kon. The concrete bit constitution of the NOD is shown in Table 2, the note data and the corresponding musical tones are shown in Table 3 and the octave data OCT and the corresponding octave ranges are shown in Table 4. Suppose that a musical tone of the sixth octave of note G# (hereinafter referred to as "G#6") is required to be provided on channel 1, the microprocessor 1-4 gives an address 00000001 and data 10011110 to the musical tone signal generating unit 1-5. Pitch detune data PDD is 8-bit data represented by two's complements among 256 two's complements in the range of $-128$ to $+127$, for modulating the tune. Release data RLD is 4-bit data for controlling damping characterisics after key-off. When the bit of a volume flag VOL is "1", the output level of the musical tone signal provided by the musical tone signal generating unit 1-5 can be controlled according to volume data VLD. Damper flag DMP indicates quick damping after key-off for a piano-type envelope, which functions when DMP$-1$. Solo flag SOL is provided for deciding whether or not the matching of the phase characteristics of a musical tone signal provided in channel and those of the same musical tone assigned in another channel. When SOL$=1$, phase matching is cancelled. Tablet data TAB is 5-bit data in which data selected by the tablet 1-2 of FIG. 1*a* is entered. When a pitch extend flag PE is bit "1", the corresponding channel is subject to pitch extend. Volume data VLD controls, in combination with the volume flag VOL, the level of the output musical tone signal of the channel at a 8-bit fineness. A series of these data can be individually assigned to channels.

The arithmetic sequence of the musical tone signal generating unit 1-5 will be described hereinafter.

Tables 5 and 6 show the arithmetic sequence of the musical tone signal generating unit 1-5. The arithmetic sequence has an initial mode and a normal mode to carry out data processing operation within a short cycle. The initial mode and the normal mode each has a long sequence and a short sequence. The initial mode short sequence and the normal mode long sequene each has an EVEN-state and an ODD-state.

In the initial mode, when the microprocessor 1-4 gives a new command for musical tone signal generation to the musical tone signal generating unit 1-5, initialization of the channel of the musical tone signal generating unit 1-5 assigned by the microprocessor 1-4 is executed. In the initial mode, first the long sequence is carried out, then the short sequence is carried out twice, and then the initial mode is exchanged for the normal mode. In the initial mode, the first short sequence is a short sequence of the ODD-state and the second short sequence is a short sequence of the EVEN-state. After the completion of the initial mode, the normal mode is started, in which the short sequence is carried out six times, and then the long sequence is carried out once.

In this embodiment, two individual waveforms are multiplied by two individual envelopes for each channel. This embodiment is capable of fine regulating function; however, time shared operation for the eight channels requires numerous steps. Operations to be carried out in a short cycle are included in the short sequence, while those to be carried out in a long cycle, namely, those which are not operated frequently, are included in the long sequence. The long sequence is inserted between the short sequences to improve the efficiency of operation.

Figure 1C:
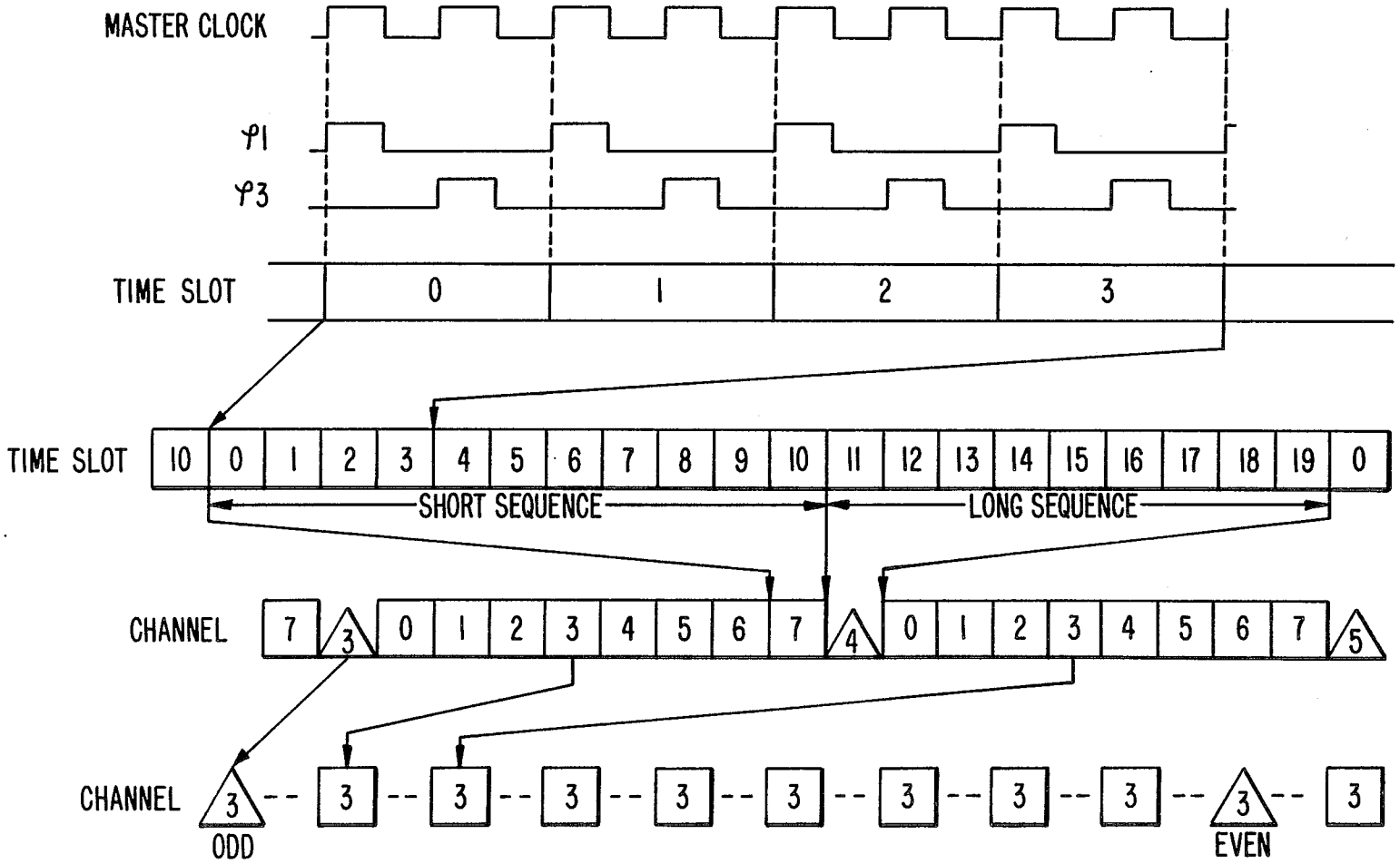
FIG. 1*c* is a diagram showing operation time slots employed in the present invention.

FIG. 1*c* is a time chart of the short sequence and the long sequence. The short sequence consists of eleven time slots 0 to 10, while the long sequence consists of nine time slots 11 to 19. The width of each time slot is 250 ns, which is divided into four sections. The system operates with a nonoverlapping two-phase clock signals of $\phi$1 and $\phi$3. The long sequence for one channel is inserted in the short sequence for eight channels 0 to 7. Accordingly, for example, the short sequence and the long sequence for channel 3 appear every $97=11\times8+9$ time slots and $776=97\times8$ time slots, respectively. Since the normal mode long sequence has the EVEN-state and the ODD-state, the cycle of operation of the system corresponds to $776\times2=1552$ time slots.

The individual arithmetic sequences will be described hereinafter with reference to Tables 5 and 6. As mentioned above, when a new key is depressed, the musical tone signal generating unit 1-5 start the initial mode long sequence. First, the time slots for the initial mode long sequence will be described.

Adding Part

(13) PDD+PED→PDR
(15) 0→TR1
(16) 0→TR2
(17) 0→ZR1
(18) 0→ZR2

The time slot 13 means adding the contents of registers PDD and PED and storing the sum in a register PDR, and the time slots 15 to 18 mean writing "0" in registers TR1, TR2, ZR1 and ZR2, respectively.

Data Bank Reading Part

(12) WTD→HAD→HAD
(14) HAD→CONT→CONT, DIF1
(16)~(17) HAD→STE→EAR1

The above representations mean reading out data (CONT for the time slot 14) written in the middle by using the data (HAD for the time slot 14) as an address from the data bank 1-6 and storing the data read out from the data bank 1-6 in a register or registers (CONT and DIF1 for the time slot 14) written on the right.

INITIAL MODE SEQUENCE

Adding Part (1) PDR+JD L.B.; 0→ER2/1
(3) ORG+OCT+1→WE2→ΔWAR
(4) D.B.+EAR1→EAR2
(6) 0→WR1
(8) 0→ER1
(9) 0→WE2
(10) 0→WE1, WR2

In the time slot 1, 0→ER2/1 means writing "0" in a register ER2 and in a register ER1 in the first short sequence, namely, in the ODD-state, and in the second sequence, namely, in the EVEN-state, respectively. L.B. means transferring the result of PDR+JD through a bus L to a multiplying part, which will be described later, without storing the result PDR+JD in any register. In the time slot 3, the representation means temporarily storing the result of operation in a register WE2 and storing the same in a register ΔWAR after decoding. In the time slot 4, the representation D.B. means transmitting data read out from the data bank by a data bank reading part, which will be described later, to an adder without storing the data in any register.

Multiplying Part (4) (6) C.B.×CN1→FR

C.B. means directly transmitting the output of the adding part to the multiplying part without storing the output in any register. In this case, the output corresponds to PDR+JD obtained in the time slot 1.

Data Bank Reading Part (1) HAD→ΔSTE→A.B.
(3)~(4) EAR1/2→E1/2→ΔT1/2, ΔE1/2, ΔZ1/2
(6)~(7) HAD→STW/ΔSTW→STW/WAR A.B. in the time slot 1 means directly transmitting the data read out from the data bank to the input A of the adding part without storing it in any register. STW/ΔSTW→STW/WAR in the time slots 6 and 7 means reading out data STW and storing the same in a register STW in the first short sequence, namely, in the ODD-state, and reading data ΔSTW in the second short sequence, namely, in the EVEN-state, and storing it in a register WAR.

The normal mode will be described hereinafter.

NORMAL MODE SHORT SEQUENCE

In Table 6, representations marked with "*" indicate operations to be performed only by the first short sequence after a note clock pulse has been produced. A flag for controlling those operations is designated as a calculation request flag CLRQ.

Adding Part (1) WE2+WE1+L.B.
(2) STW+WAR+D.B., B.B.
(3) ZR1+ΔZ1→ZR1
(4) DIF 1+C.B.→D.B.
(5) ER1+ΔE1+Ci→ER1
(6) ZR2+ΔZ2→ZR2
(7) WAR+ΔWAR→WAR*
(8) ER2+ΔE2+Ci→ER2
(9) FR+CDR→CDR*

In the time slot 1, L.B. indicates directly transmitting the result of calculation to the multiplying part without storing it in any register. In the time slot 2, D.B., B.B. indicates directly transmitting the result of calculation to the data bank reading part and the input B of the adding part, respectively. In the time slot 4, C.B. indicates the direct input of the result of operation of the adding part without storing it in any register. In this case, the result of calculation STW+WAR in the time slot 2 is provided, and D.B. indicates direct application of the result of calculation to the data bank reading part.

In the time slots 5 and 8, Ci indicates the carry of the result of the operation.

Multiplying Part (1)~(3) WR2+ER2→WE2*
(4)~(6) C.B.×CN→(DAC)
(7)~(9) WR1×ER1→WE1*

In the time slots 4 to 6, C.B. indicates direct application of the output of the adding part to the multiplying part without storing it in any register. In this case, the output corresponds to WE2+WE1 in the time slot 1. (DAC) indicates giving the result of operation to a DAC (DA converter, which will be described later).

Data Bank Reading Part (4)~(5) C.B.→W1→WR1*
(7)~(8) C.B.→W1→WR2*

In the time slots 4 and 5, C.B. indicates direct transmission of result to calculation to the data bank reading part as the address of the data bank 1-6, in which the result of calculation corresponds to STW+WAR of the time slot 2. In the time slots 7 and 8, C.B. also corresponds to the result of calculation DIF1+(STW+-WAR) in the time slot 4.

LONG SEQUENCE

Adding Part

(13) ΔT1/2+TR1/2→TR1/2
(14) PDR+JD→L.B.
(15) ΔEAR1/2+EAR1/2+Ci→EAR1/2
(16) PDD+PED→PDR

In the time slot 14, L.B. indicates direct transmission of the result of calculation in the adding part, namely, PDR+JD, to the multiplying part without storing it in any register. In the time slot 15, Ci indicates carry resulting from the operation in the time slot 13.

Multiplying Part (16)~(18) CN+C.B.→FR

C.B. indicates direct transmission of the result of the calculation in the adding part, where inputted is the result of the calculation PDR+JD in the time slot 14.

Data Bank Reading Part (14)~(15) EAR2/1→E2/1→ΔT2/1, ΔE2/1, ΔZ2/1

In the above representation, "2/1" indicates that "2" for the ODD-state (for example, E2/1 is E2 in the ODD-state) and "1" for the EVEN-state (E1); separate data are read out in the ODD-state and EVEN-state and the separate data are stored in separate registers, respectively.

Figure 2:
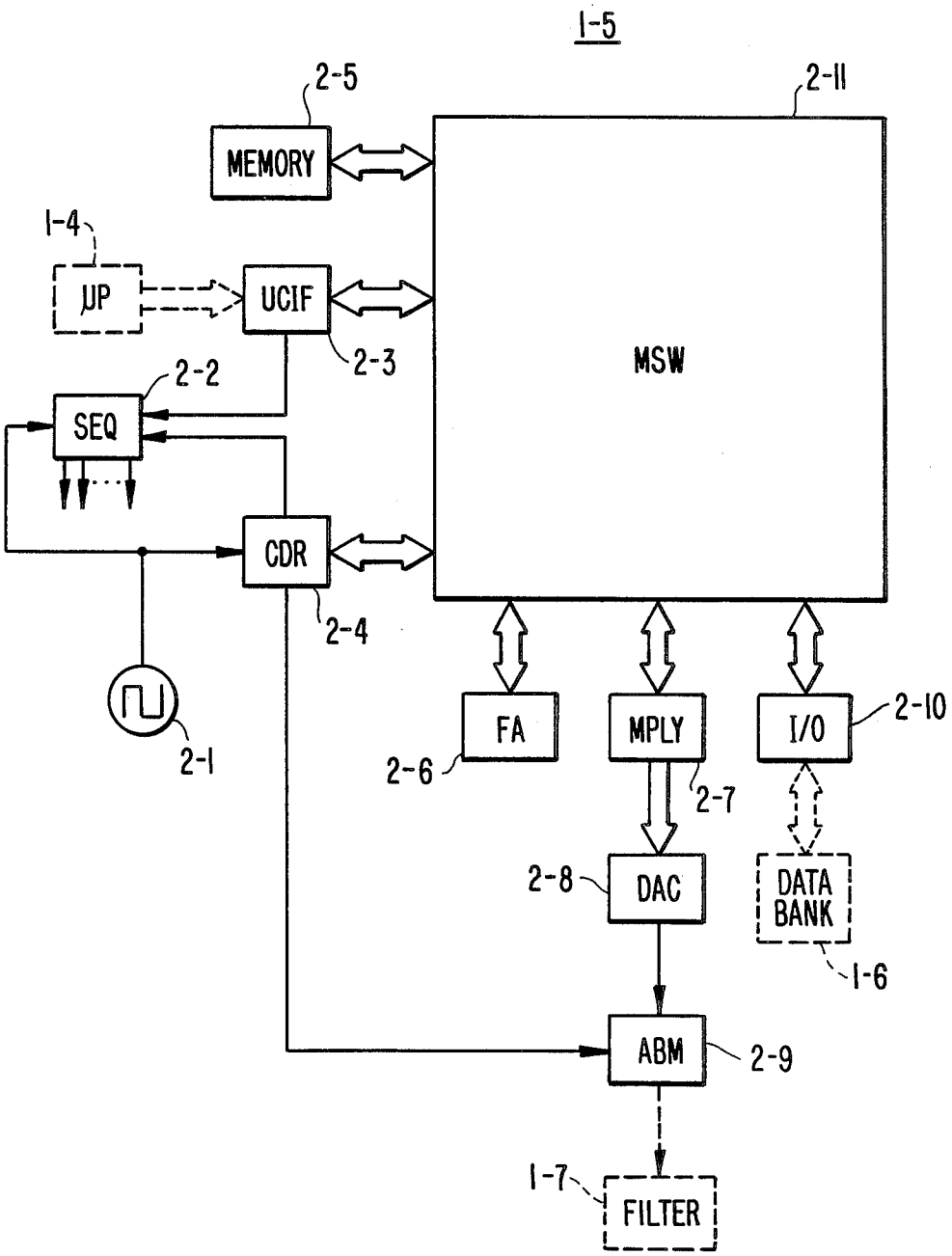
FIG. 2 is a block diagram of a musical tone signal generating unit 1-5 according to the present invention.

FIG. 2 is a detail view of the musical tone signal generating unit (tone generator) 1-5 of FIG. 1*a*. In FIG. 2, there are shown a master clock 2-1 which generates clock pulses of a frequency f=8.00096 MHz, a sequencer 2-2 (hereinafter referred to as "SEQ") which divides the master clock 2-1 and generates a sequence signal (hereinafter referred to as "SQ signal") of the musical tone signal generating unit 1-5 and various control signals, a microprocessor interface (hereinafter referred to as "UCIF") 2-3 which receives data provided by the microprocessor 1-4 asynchronously with the musical tone signal generating unit 1-5 and matches the data to the SQ signal provided by the SEQ, and also generates a flag INI indicating mode change between the initial mode and the normal mode, a comparison register (hereinafter referred to as "CDR") 2-4 which compares the data of eight channels of the register CDR shown by the arithmetic sequence with a division signal of ten bits obtained by sequentially dividing the master clock signal, and then generates note clock signals for eight channels and a calculation request flag CLRQ, a random access memory (hereinafter referred to simply as "memory") 2-5 which stores various results of the calculation performed by the musical tone signal generating unit 1-5, a full adder unit (hereinafter referred to as "FA") 2-6 having a 16-bit full adder which performs the addition of various data, a multiplying unit (hereinafter referred to as "MPLY") 2-7 having a multiplier which executes an operation represented by (two's complement of twelve bits)×(absolute value of ten bits), a digital-to-analog converter (hereinafter referred to as "DAC") 2-8 which converts digital musical tone data provided by the MPLY 2-7 into the corresponding analong musical tone data, an analog buffer memory unit (hereinafter referred to as "ABM") 2-9 which synchronizes musical tone data provided by the DAC 2-8 at the machine cycle by the note clock pulse provided by the CDR 2-4, an input-output circuit (hereinafter referred to as "I/O") 2-10 which gives address signals to the data bank 1-6, reads out waveform data and envelope data corresponding to the address signals and, if necessary, converts the read data, and a matrix switch unit (hereinafter referred to as "MSW") 2-11 which connects lateral bus lines HA, HB, HC, HD, HE and HL connected to the UCIF 2-3, CDR 2-4 and memory 2-5 and longitudianl bus lines A, B, C, D and L connected to the FA 2-6, MPLY 207 and I/O 2-10, according to the SQ signal. These circuits executes the arithmetic sequences shown in Tables 5 and 6. The functions and constitution of the ABM 2-9 are the same as those of an analog buffer memory disclosed in Unexamined Japanese Patent Publication (Kokai) No. 59-214091.

The individual circuits of the musical tone signal generating unit 1-5 will be described hereinafter.

Figure 4:
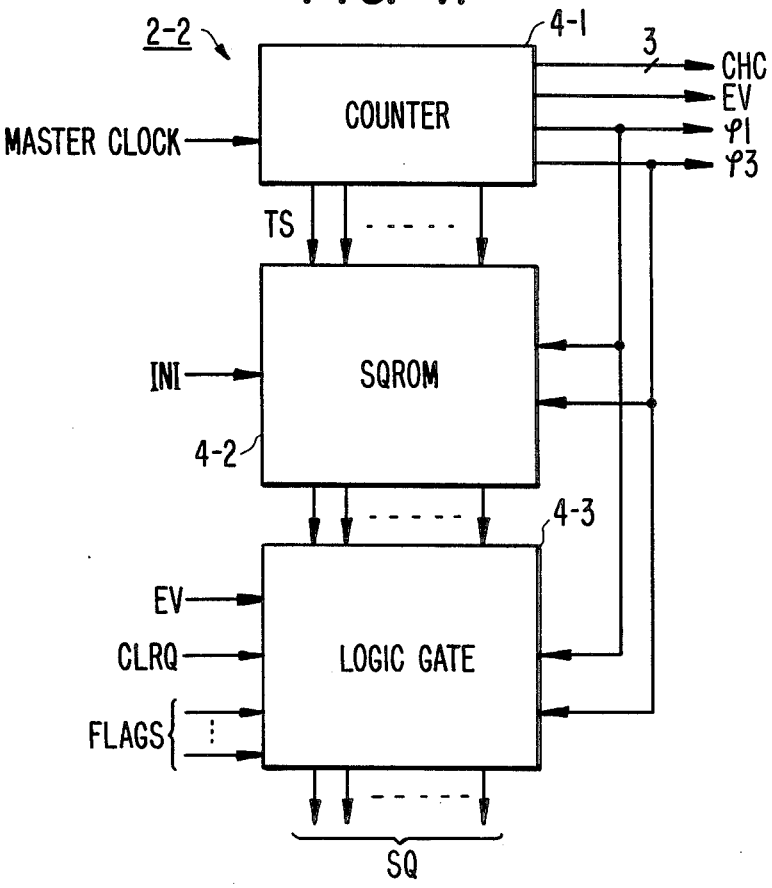
FIG. 4 is a detail view of the SEQ 2-2 of the musical tone signal generating unit 1-5.

FIG. 4 is a detail view of the SEQ 2-2 of FIG. 2. The SEQ 2-2 has a counter 4-1, a sequence ROM (SQROM) 4-2 and a logic gate 4-3. The counter 4-1 divides the master clock signal and produces various timing signals shown in FIG. 1*c*. Signals TS represent the time slots of FIG. 1*c*, a channel code CHC is a signal representing the channel number in FIG. 1*c*, a signal EV indicates the ODD-state and the EVEN-state of the arithmetic sequences, in which EV=0 and EV=1 indicate the ODD-state and the EVEN-state, respectively. The time slot signals TS and flag INI are supplied to the address input of the SQROM 4-2. The SQROM 4-2 produces various control instructions for a time slot on the basis of those input signals. The logic gate 4-3 controls the output of the SQROM 4-2 by various flags and the flag CLRQ and produces SQ signals to instruct the manner of operation of the functional circuits for each time slot, according to the instructions given thereto by means of the effect switches 1-3 and playing information. In FIG. 4, the SQ signals are indicated by SQ.

Figure 5:
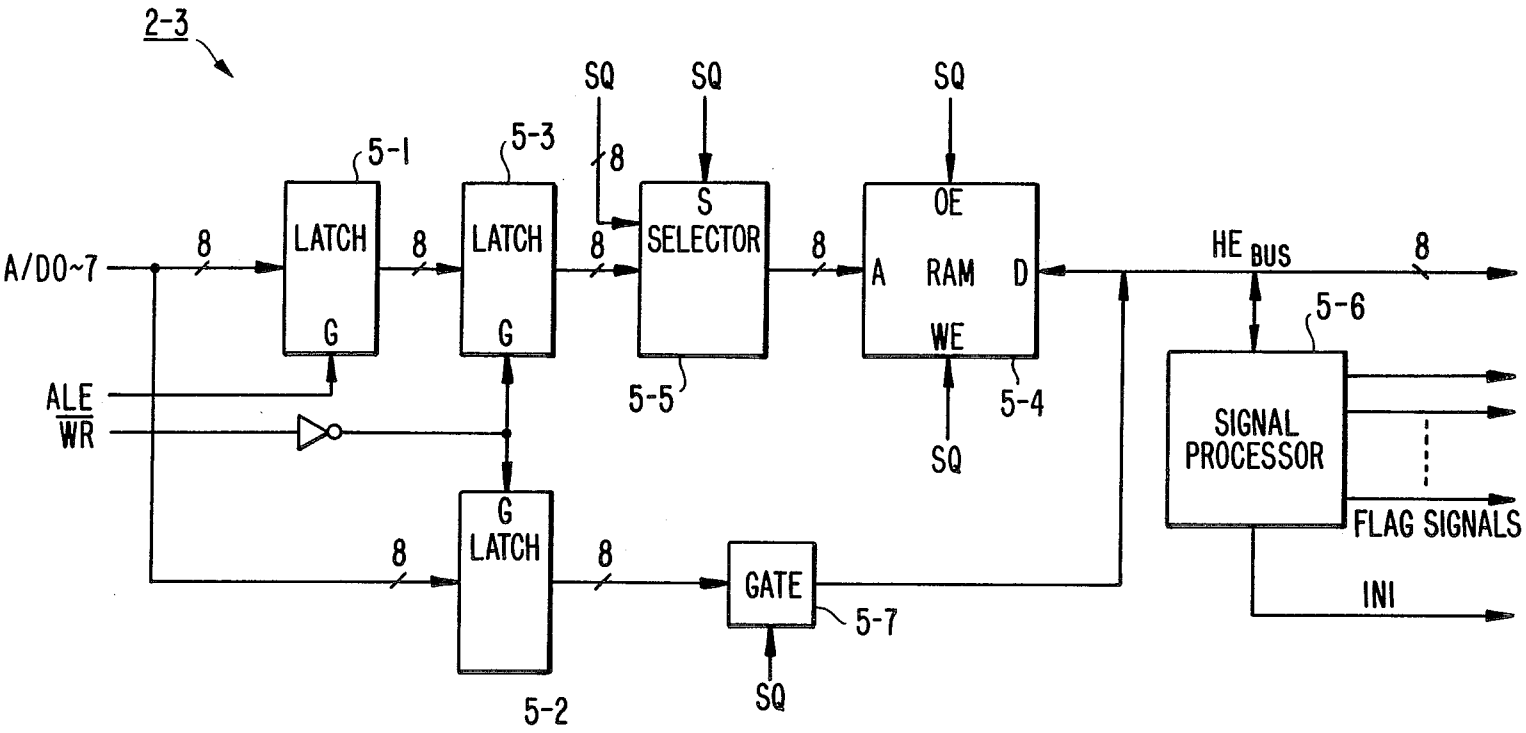
FIG. 5 is a detail view of the UCIF 2-3 of the musical tone signal generating unit 1-5.

FIG. 5 is a detail view of the UCIF 2-3. Referring to FIG. 5, a latch 5-1 latches A/D 0 to 7 given thereto from the micorprocessor 1-4 of FIG. 1*a* by ALE. The relation between the A/D 0 to 7 and the ALE is shown in FIG. 1*b*. The latch 5-1 latches the addresses shown in Table 1. A latch 5-2 latches the A/D 0 to 7 given thereto from the microprocessor 1-4 by $\overline{WR}$. Since the A/D 0 to 7 are related to the $\overline{WR}$ as shown in FIG. 1*b*, the latch 5-2 latches the data shown in Table 1. A latch 5-3 latches the output of the latch 5-1 under the control of the $\overline{WR}$. The addresses are latched at two stages because the ALE becomes "1" periodically regardless of the $\overline{WR}$. Latching the addresses at two stages, the latches 5-3 and 5-2 store the addresses and data until new data is written by the $\overline{WR}$. A 1-word 8-bit RAM 5-4 has as address input terminal A, an output control terminal OE and a data terminal D connected to a bus line HE. When OE=1, an address given to the address input terminal A is provided from the data terminal D. Indicated at WE is a write control terminal. When WE=1, data given to the terminal D is written in an address given to the input terminal A. The output control terminal OE and the write control terminal WE are controlled by the SQ signals. A RAM 5-4 has eight channels storing various data shown in Table 1 (NOD, PDD, RLD.VOL.DMP.SOL, TAB.PE, VLD), control data CONT (data fetched from the data bank) and data PDR stored in a pitch data register. A selector 5-5 selectively gives, on the basis of another SQ signals, addresses specified by the microprocessor 1-4 and addresses specified by the SQ signals to the input terminal A of the RAM 5-4. A signal processor 5-6 is connected to the bus line HE. The signal processor 5-6 receives data from the bus line HE and produces various flag signals. The signal processor 5-6 also produces sixteen releasing envelopes corresponding to four bits of release data RLD provided by the microprocessor 1-4 and provides the releasing envelopes on the bus line HE. A gate 5-7 is opened by the SQ signal to provide the output of the latch 5-2, namely, the data provided by the microprocessor 1-4, on the bus line HE.

The functions of the UCIF 2-3 will be described hereinafter.

Suppose that the data shown in Table 1 is fed to the UCIF 2-3 from the microprocessor 1-4 in the manner as shown in FIG. 1*b* and, for example, an address $05_{16}$ and data $89_{16}$ is specified, namely, keying for F#1 is specified to the channel 5. First, the signal ALE causes the latch 5-1 to latch the address, and then the signal $\overline{WR}$ causes the latch 5-2 to latch the data and the latch 5-3 to latch the address. Then, the selector 5-5 selects the output of the latch 5-3 at a predetermined time and the gate 5-7 is opened to feed a write signal to the WE of the RAM 5-4. Consequently, the data latched by the latch 5-2, namely, the data $89_{16}$ specified by the microprocessor 1-4, is provided on the bus line HE and the latch 5-3 gives a signal specifying the address $05_{16}$ to the input terminal A of the RAM 5-4, and thereby the data $89_{16}$ is written in an address $05_{16}$ of the RAM 5-4. Thus, various data shown in Table 1 are written in the RAM 5-4. As shown in Table 1, the RAM 5-4 stores flags such as VOL flags PE flags. These flags are fed through the bus line HE to and are latched temporarily by the signal processor 5-6.

Figure 6:
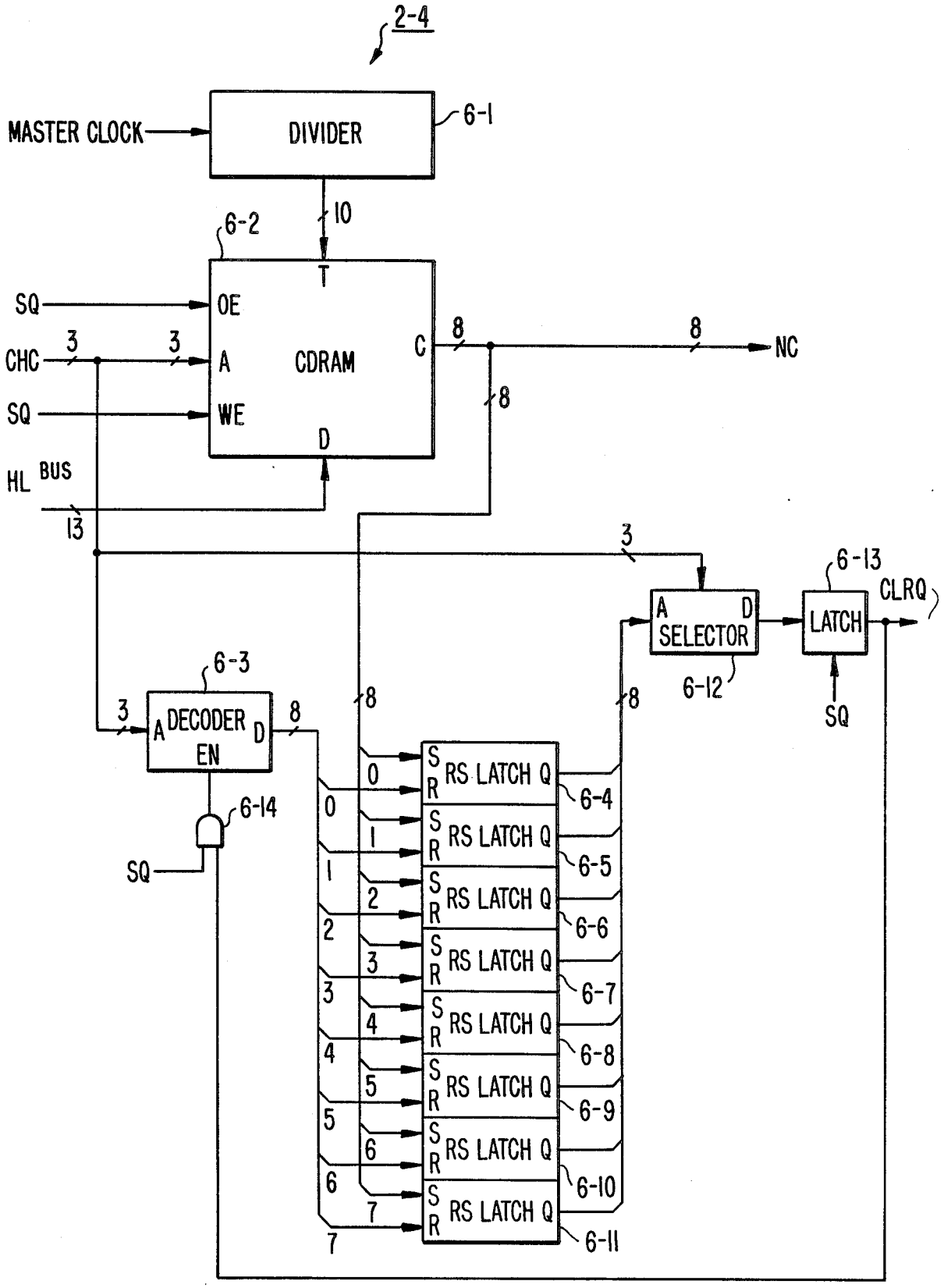
FIG. 6 is a detail view of the CDR 2-4 of the musical tone signal generating unit 1-5.

FIG. 6 is a detail view of the CDR 2-4. A ten-bit divider 6-1 receives the master clock signal. A RAM with comparator 6-2 (hereinafter referred to as "CDRAM") has eight words each of thirteen bits. The upper ten bits of each word is provided with a comparator which compares the ten bits with data divided by the divider 6-1 fed to a terminal T. When all the ten bits are equal, an equal pulse is provided from a terminal C. The functions of OE, WE, A and D are the same as those of the RAM 5-4. Indicated at 6-3 is a decoder. The relationship between A- and EN-input and D-output is shown in Table 8. Elements 6-4 to 6-11 are RS flip flops; when a positive pulse signal is fed to the input terminal S, the output at the output terminal Q is "1", and when a positive pulse signal is fed to the input terminal R, the output at the output terminal Q is "0". The equal pulses of the channels 0, 1, . . . are fed to the input terminals S of the RS flip flops 6-4, 6-5, . . . . A selector 6-12 selects one signal from among eight input signals given to the input terminal A, according to a channel code CHC 3 bit, and provides the selected signal from the output terminal D. A latch 6-13 latches the output of the selector 6-12 according to the SQ signal. Element 6-14 is an AND gate.

In operation, the divider 6-1 divides the master clock signal and gives ten bits of divided output to the input terminal T of the CDRAM 6-2. Each word of the CDRAM 6-2 has an optional value. An equal pulse signal is provided from the terminal C for every coincidence of the value of each word with the output of the divider 6-1. Since the CHC, i.e., a signal indicating a channel is applied to the input terminal A of the CDRAM 6-2, each word corresponds to each channel, and hence an equal pulse signal is given for each channel. Since the equal pulse signals are given to the RS flip flops 6-4 to 6-11, the outputs Q of the RS flip flops corresponding to the channels carrying the equal pulse signals become "1". The outputs Q of the RS flip flops 6-4 to 6-11 are selected sequentially one by one on the basis of the channel code CHC and are latched by the latch 6-13. Since the output of the latch 6-13 is given to the AND gate 6-14, when the output Q of the RS flip flop presently selected by the selector 6-12 is "1", the relevant channel connected to the output terminal D of the decoder 6-3 is changed to "1" by the SQ signal given to the AND gate 6-14, and thereby the output terminal Q of the RS flip flop is reset to "0".

Figure 7:
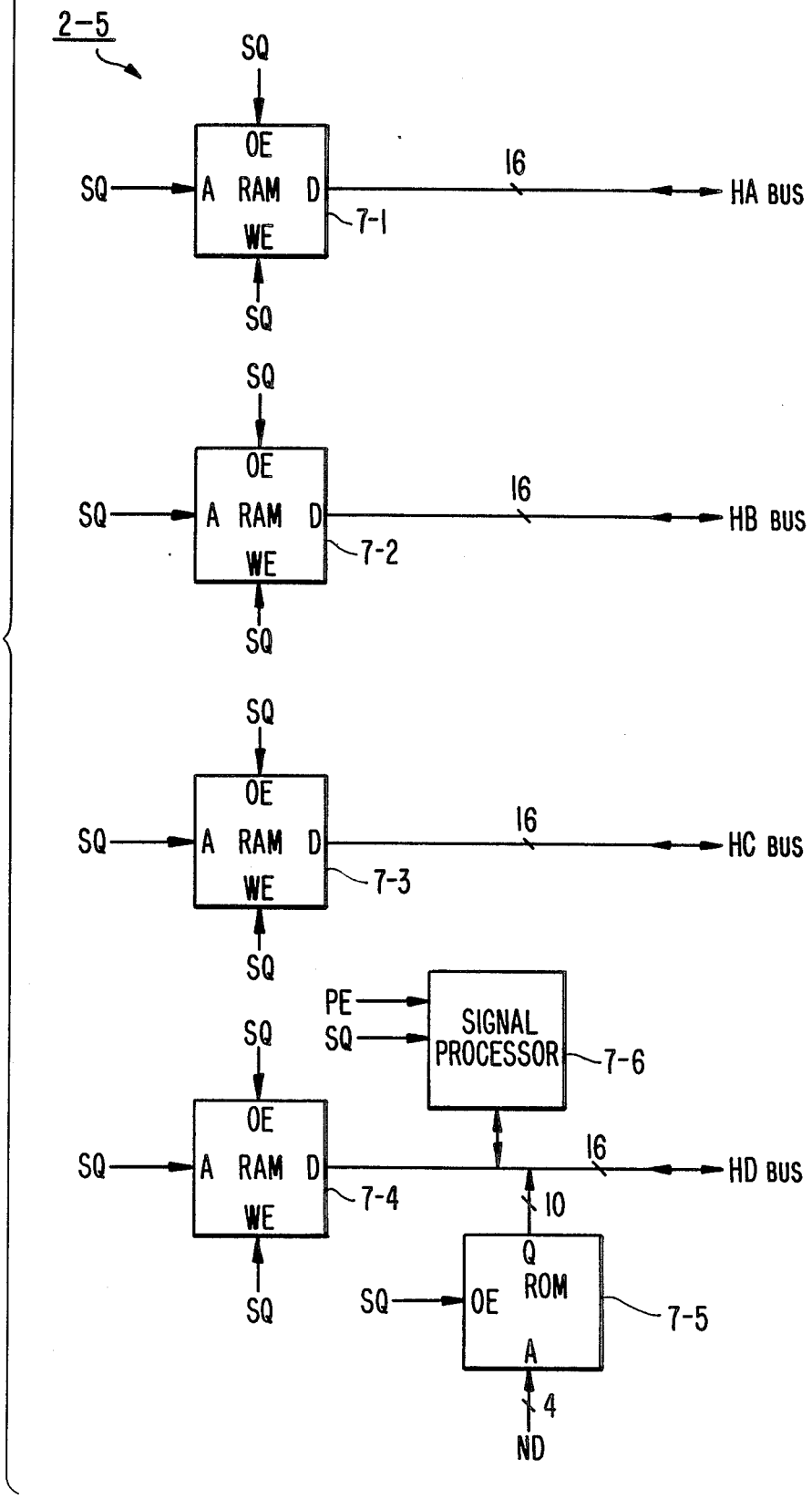
FIG. 7 is a detail view of the memory 205 of the musical tone signal generating unit 1-5.

FIG. 7 is a detail view of the memory 2-5. In FIG. 7, elements 7-1 to 7-4 are RAMs, the functions of the OE, WE, A and D of which are the same as those of the RAM 5-4. The RAMs 7-1, 7-2, 7-3 and 7-4 store the registers for eight channels of WAR, EAR1, ΔZ1, ΔE1, EAR2, ΔZ2 and ΔE2, the resisters for eight channels of WR2, ZR1, ΔT1, FR, ΔWAR, ZR2 and ΔT2, the registers for eight channels of ER1, TR1, DIF1, DW1, ER2, TR2, STW, TAB' and HAD, and the registers of eight channels for NOD', WE2 and VLD', respectively. NOD', TAB' and VLD' are the data of NOD, TAB and VLD written in RAM 5-4. Element 7-5 is a ROM for thirteen words each of ten bits. The ROM 7-5 stores note sequences of the arithmetic sequences shown in Tables 5 and 6. The ROM 7-5 has an address input terminal A, an output terminal Q and an output control terminal OE. When OE=1, the contents of the ROM is provided at the terminal Q and, when OE=0, the terminal Q is in a high impedance state. Values of note coefficients are shown in Table 7. The ten-bit output of the ROM 7-5 is connected to the lower ten bits of a bus line HD. A signal processor 7-6 has a circuit which reads out note date ND and octave data OCT from the NOD' stored in the RAM 7-4 and produces pitch detune data PED on the basis of the data ND and OCT and a PE flag, and a decoding circuit which reads out and decodes the data stored in the register WE2.

Figure 8:
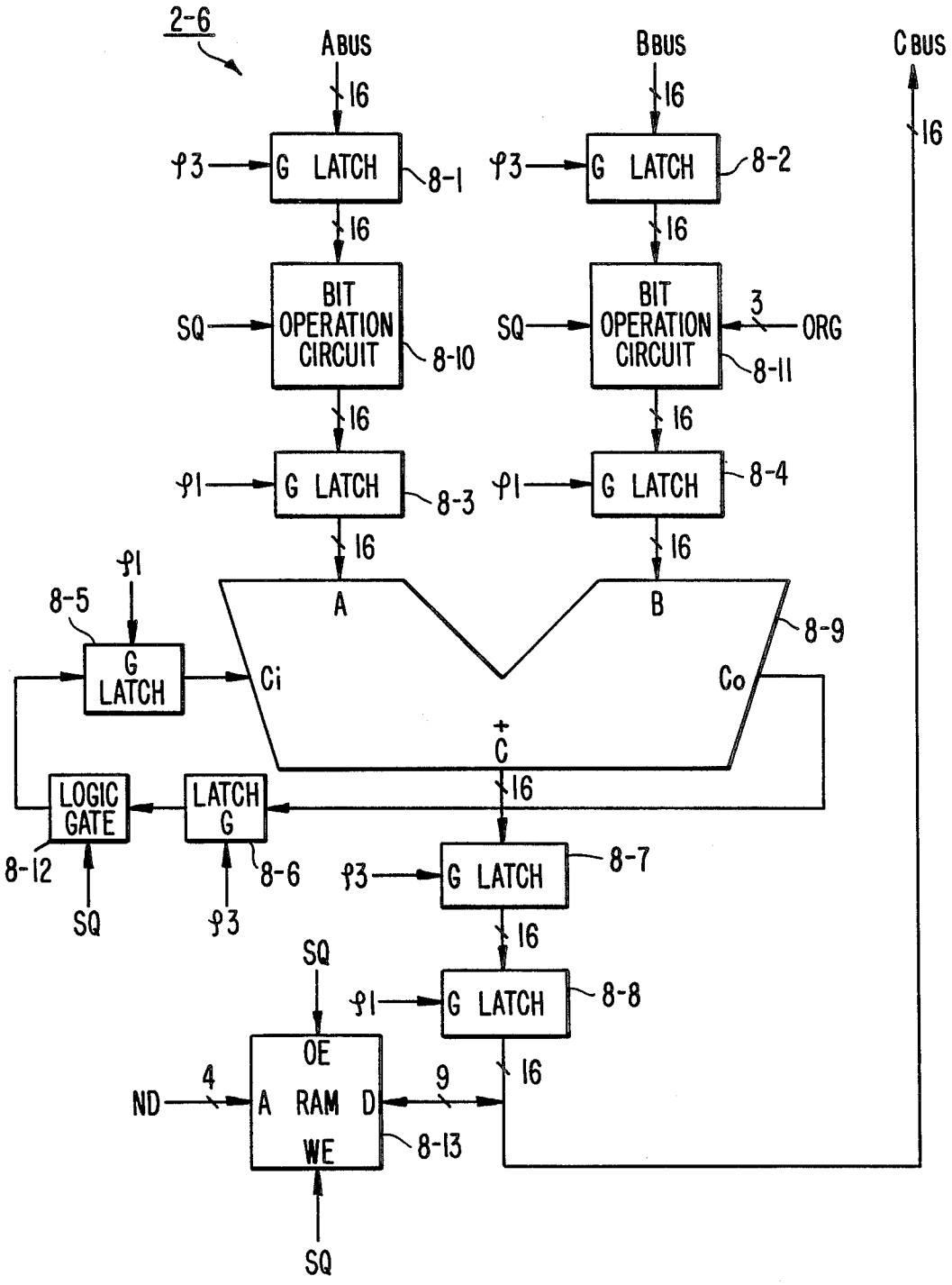
FIG. 8 is a detail view of the FA 2-6 of the musical tone signal generating unit 1-5.

FIG. 8 is a detail view of the FA 2-6. In FIG. 8, elements 8-1 to 8-8 are latches which are controlled by signals $\phi 1$ and $\phi 3$ produced by the SEQ 2-2. An adder 8-9 adds values of sixteen bits provided on an input A and an input B and value provided on carry input Ci, and provides output signals C and Co. Co is a carry output produced by calculation. Bit processing circuits 8-10 and 8-11 operate the bits of the outputs of the latches 8-1 and 8-2. A logic gate 8-12 sets the output of the latch 8-6 forcibly at "1" or "0" according to the SQ signal or passes the output of the latch 8-6. A RAM 8-13 has twelve words each of nine bits. The functions of the A, D, WE and OE of the RAM 8-13 are the same as those of the RAM 5-4. The nine bits of the output D are connected to the lower nine bits of a bus line C. A RAM 8-13 provided for phase matching, which will be described later, controls the phase of waveform data reading address WAR for each one of twelve notes.

Figure 9A:
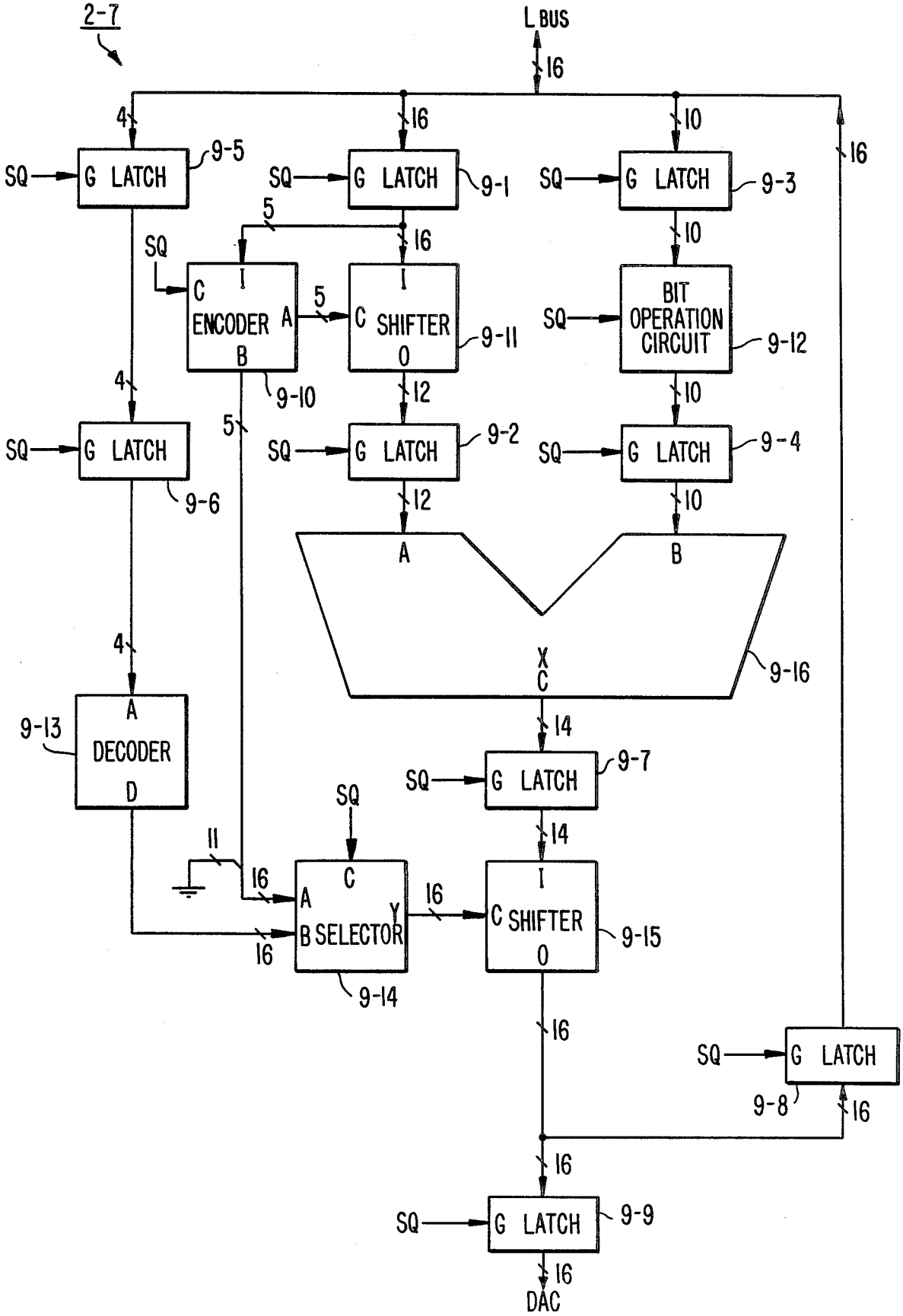
FIG. 9*a* is a detail view of the MPLY 2-7 of the musical tone signal generating unit 1-5.

FIG. 9*a* is a detail view of the MPLY 2-7. In FIG. 9*a*, elements 9-1 to 9-9 are latches. The latches 9-3 and 9-5 are connected to the bits 0 to 9 of a bus line L and the bits 9 to 12 of the bus line L, respectively. Element 9-10 is an encoder, the inputs and outputs of which are shown in Table 9. A shifter 9-11 shifts a signal of sixteen bits given to I according to a control signal given to C and provides an output signal at 0. The contents of shift are shown in Table 10. A bit processing circuit 9-12 processes the bits of the output signal of the latch 9-3 according to the SQ signal. Indicated at 9-13 is a decoder, the inputs A and the outputs D of which are shown in Table 11. A selector 9-14 provides sixteen signals given to A or sixteen signals given to B through Y when C=1 or C=0, respectively. The lower eleven bits of input A are connected to a ground potential GND, that is, the lower eleven bits are "0". A shifter 9-15 a shifts a signal of fourteen bits given to an input I according to a control signal given to C and provides an output signal through O. The contents of shift are shown in Table 12. Element 9-16 is a multiplier, in which input A is two's complements of twelve bits, input B is absolute values of ten bits and output is two's complements of fourteen bits. Normally, multiplication: (twelve bits)×(ten bits) provides a product of twenty two bits. Naturally, the fourteen bits of the output of the multiplier 9-16 are the upper fourteen bits of the twenty-two bits. Accordingly, the relationship between the input and the output of the multiplier 9-16 is represented by:

$$C=(A\times B)/256.$$

Figure 9B:
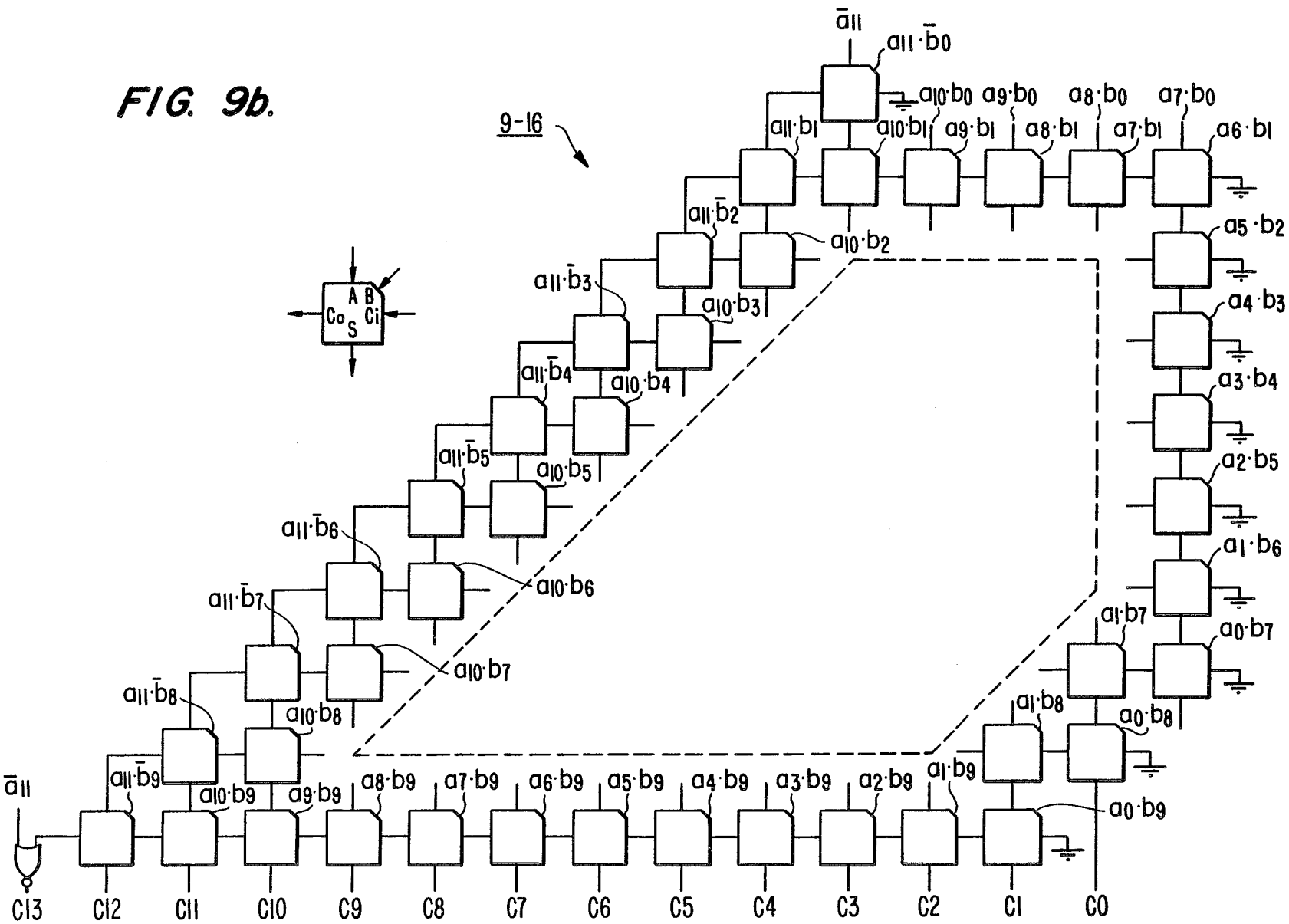
FIG. 9*b* is a detail view of the multiplier 9-16 of the MPLY 2-7.

The multiplier 9-16 of the MPLY 2-7 is constituted as follows to simplify the circuit. An ordinary multiplier for calculating (two's complement of twolve bits)×(absolute value of ten bits) has 116 adding cells to provide an accurate product of twenty-two bits; however, since the present embodiment utilizes only the upper fourteen bits and does not utilize the lower eight bits, adding cells for operating the lower seven bits which do not affect the LSB of the upper fourteen bits are omitted. Thus, in the multiplier 9-16, twenty-eight adding cells for operating the lower bits are omitted to constitute a multiplier having a constitution shown in FIG. 9*b*. In FIG. 9*b*, the same cells are arranged also in area enclosed by broken lines. Each block shown in FIG. 9*b* is an adder having inputs A, B and Ci (carry input) and outputs S (sum) and Co (carry).

Figure 10:
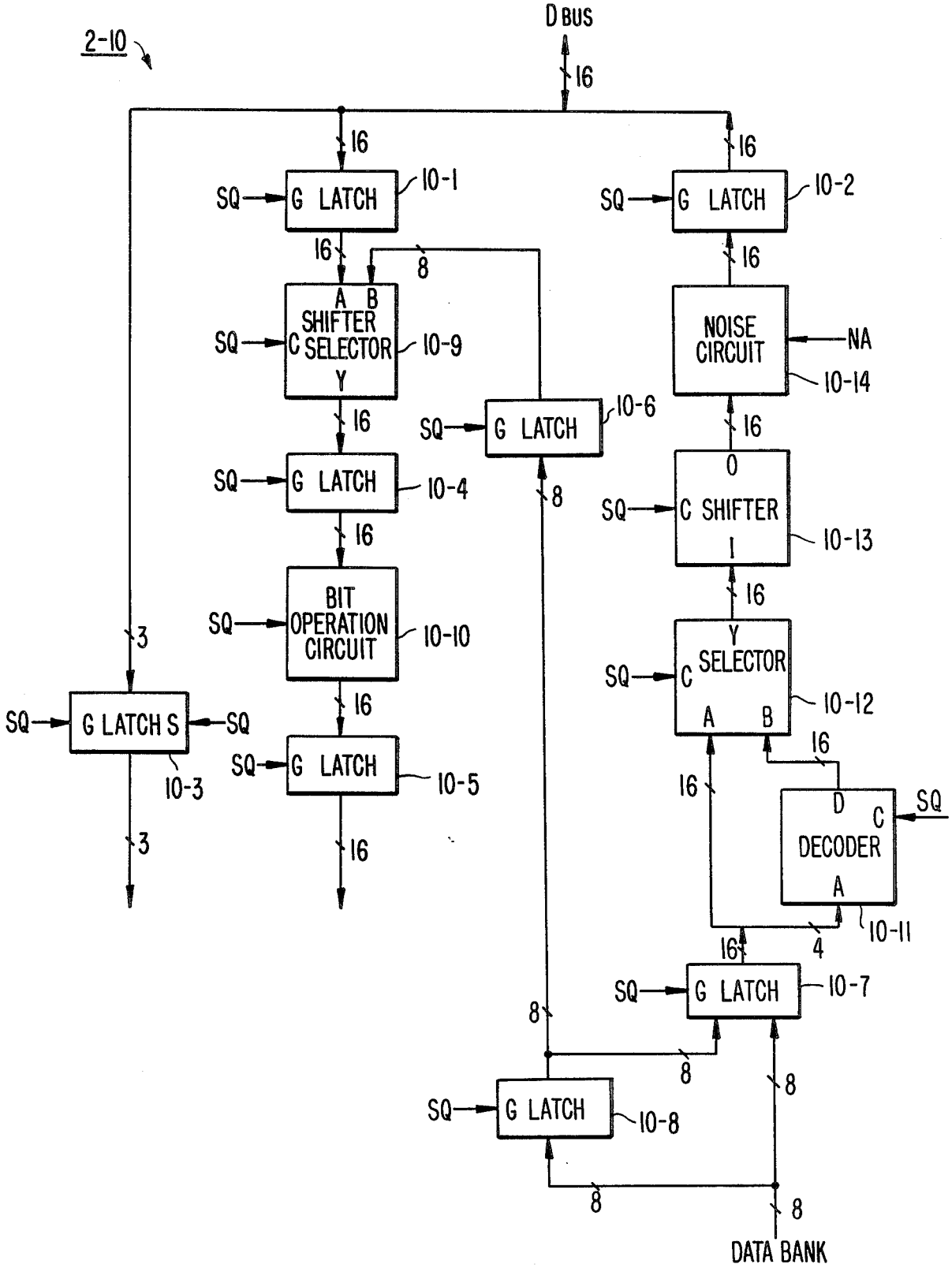
FIG. 10 is a detail view of the I/O 2-10 of the musical tone signal generating unit 1-5.

FIG. 10 is a detail view of I/O 2-10. In FIG. 10, elements 10-1 to 10-8 are latches. The latch 10-3 is a latch with set, the input of which is connected to bits 7 to 9. A shift selector 10-9 which changes the input between input A and input B according to input C and shifts input A by one bit. A bit operation circuit 10-10 sets the lower three bits forcibly at "1" or "0" according to the SQ signal. Element 10-11 is a decoder, the input I and the output D of which are shown in Table 13. The output bits 12 to 15 of the latch 10-7 are given to the input I of the decoder 10-11. A selector 10-12 provides either the input A or the input B given to input C through output Y. A shifter 10-13 shifts input given to I according to input given to a control terminal C and provides an output through O. A noise circuit 10-14 mixes a noise corresponding to a noise flag NA into input data.

Figure 11A:
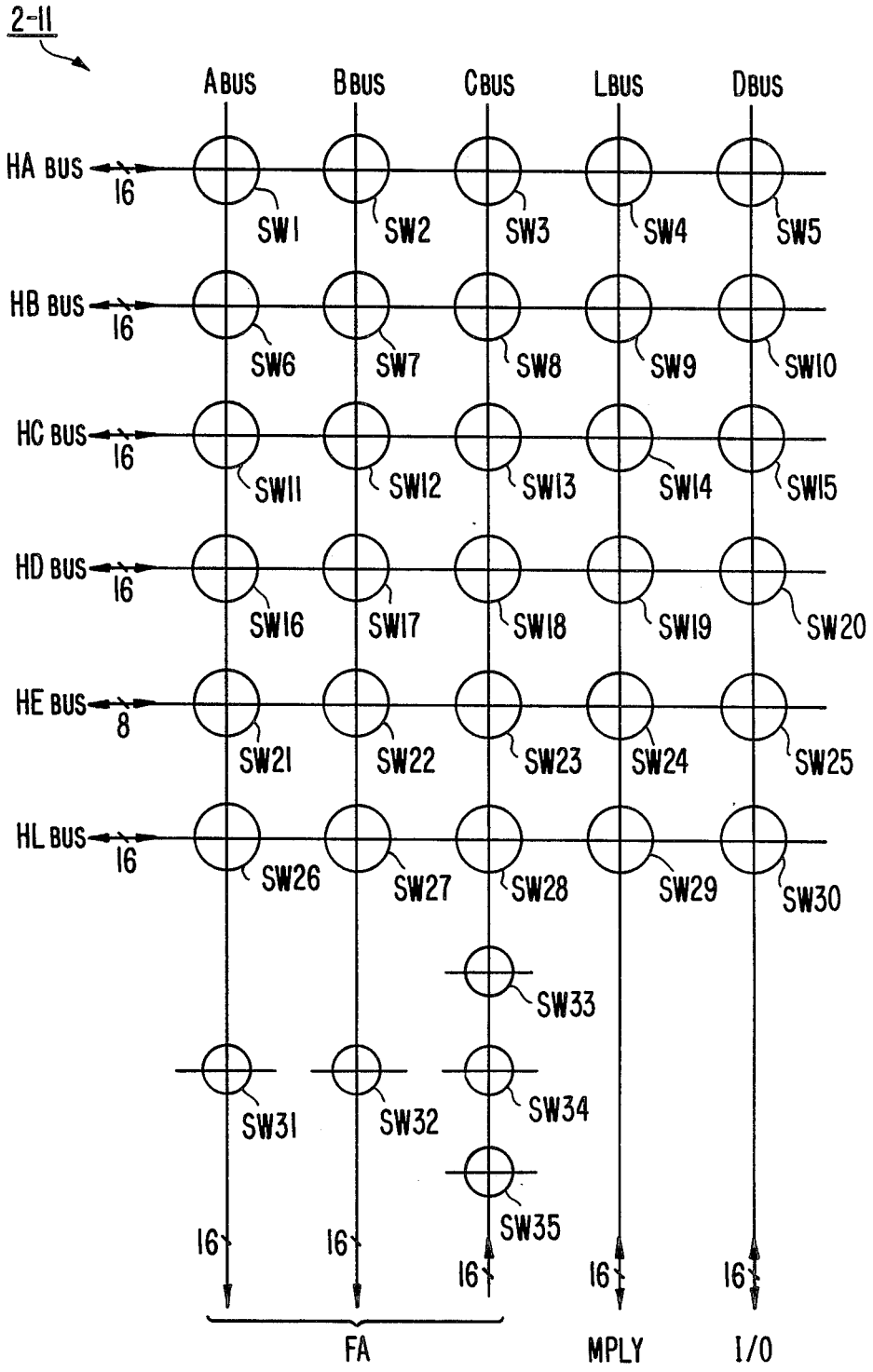
FIG. 11*a* is a detail view of the MSW 2-11 of the musical tone signal generating unit 1-5.
Figure 11B:
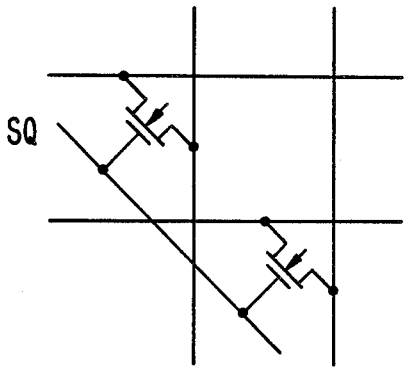
FIGS. 11*b* to 11*i* are patterns of the switch employed in the MSW 2-11 of the musical tone signal generating unit 1-5.
Figure 11C:
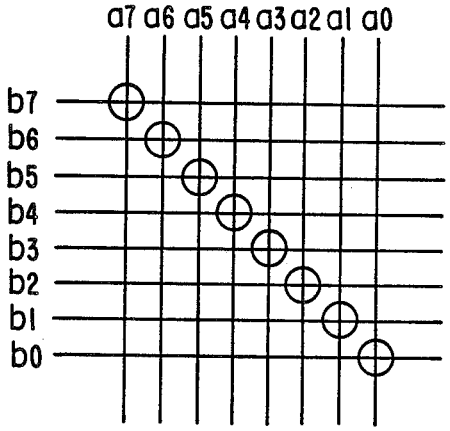
Figure 11D:
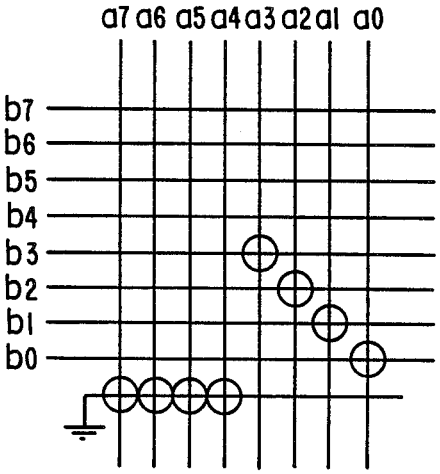
Figure 11E:
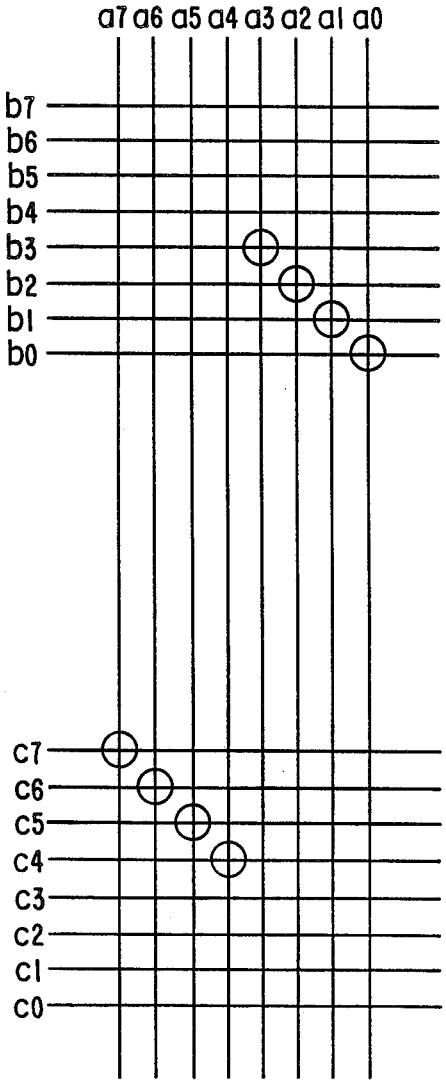
Figure 11F:
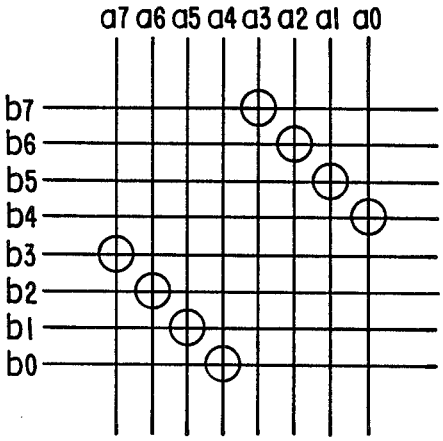
Figure 11G:
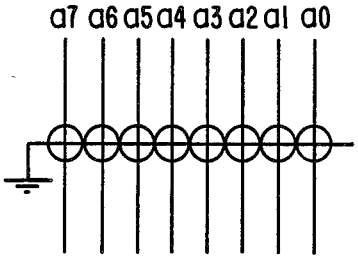
Figure 11H:
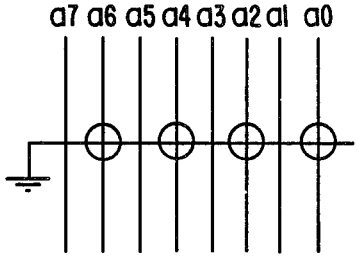
Figure 11I:
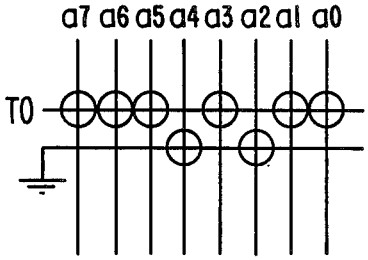
Figure 11J:
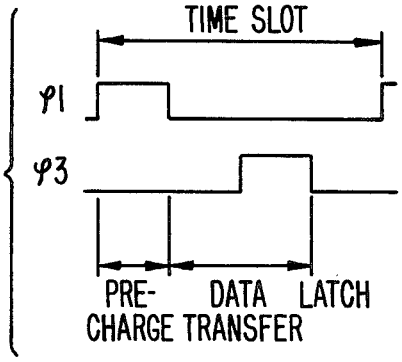
FIG. 11*j* is a time chart of data transfer operation of the MSW 2-11.

FIG. 11*a* is a detail view of MSW 2-11, in which circles represent switches, namely, MOSFETs of N-channels as illustrated in FIG. 11*b*. When SQ signal=1, the MOSFET is closed to connect the longitudinal line and the lateral line for data transfer. In this SMW 2-11, all the bus lines are precharged by the signal $\phi 1$ before data transfer for quick data transfer. Since the switch is a MOSFET of N-channels, the bus lines are precharged to prevent the drop of the level of "1" of data by a value corresponding to the threshold voltage of the MOSFET. Examples of switch patterns employed in the MSW 2-11 are illustrated in FIGS. 11*c* to 11*i*, in which intersection points encircled by circles are connected by the switches. In these examples, each bus line is supposed to be of eight bits, for convenience' sake. In FIG. 11*c*, bn and an (n=0 to 7) are connected by the switches. In FIG. 11*d*, values of four bits b0 to b3 and "0" are written through the switches in the longtitudinal bus. In FIG. 11*e*, bits b0 to b3 and bits c4 to c7 are written in bits 10 to a3 and in bits a4 to a7, respectively, so that data provided in two buses are mixed and the mixed data is transferred to another bus. In FIG. 11*f*, bit position is changed for data transfer from bus to bus. In this switch arrangement, the upper four bits and the lower four bits of the data of the lateral bus are inverted to transfer data to the longitudinal bus. FIGS. 11*g* to 11*i* illustrates exemplary circuits for setting a constant in the bus. The circuit of FIG. 11*g* sets all the bits of the bus at "0". The circuit of FIG. 11*h* sets 101010101, namely, $AA_{16}$ in the bits of the bus. Bits a7, a5, a3 and a1 not having any switch hold "1" written immediately before the switch is opened by precharging. FIG. 11*i* shows an arrangement for changing the value of constants by a flag TO. When TO=0, $00_{16}$ is written in the bus and, when TO=1, $EB_{16}$ is written in the bus. The switches shown in FIGS. 11*c* to 11*i* are arranged in the MSW 2-11 according to the purpose and are operated selectively to achieve data transfer from an optional bus to another optional bus including necessary bit operation. For example, when simultaneous data transfer from bus HA to bus A, from bus HB to bus B and from bus C to bus HC is required, the switches SW1, SW7 and SW13 are closed simultaneously. When the data transfer from bus C to buses L and D, switches SW28, SW29 and SW30 are closed, and thereby the data is transferred from bus C through bus HL to buses L and D. In the MSW 2-11, data transfer is carried out at a time shown in FIG. 11*j*. In a period corresponding to $\phi 1=1$, the longitudinal and lateral bus lines are precharged, in a period from the trailing edge of $\phi 1$ and the leading edge of $\phi 3$, the data is transferred, and the data is latched at the trailing edge of $\phi 3$. There is a sufficient time for stable latching operation between the trailing edge of $\phi 3$ and the leading edge of $\phi 1$.

The data bank 1-6 will be described hereinafter. The data bank 1-6 stores four kinds of data, namely, header address data (1), header data (2), waveform data (3) and envelope data (4). The header address data is eight-bit data indicating the address of the header data, and header data is eight-bit data indicating the addresses and the attribute of the waveform data and the envelope data. The four kinds of data will be described in detail hereinafter.

(1) Header Address Data (HAD)

Header address data indicates the address of the header data by a note assigned to each tablet, each octave and every three keys. The addresses of the header address data are shown on Table 14. Tablet data TAB, octave data OCT, the upper two bits of note data ND and "1" are stored in bits 9 to 5, bits 4 to 2, bits 1 to 0 and the rest of the bits. The ten bits consisting of TAB, OCT and ND are designated as WTD, each of which are shown in Table 1. Table 15 shows the addresses of the header data indicated by the header address data, in which the header address data is stored in bits 10 to 3 and all the upper bits are "1", while data of 000 to 111 are store in the lower three bits.

(2) Header Data

The header data is a data of eight words each of eight bits stored in addresses shown in Table 15. The contents of the eight words are shown in Table 16, in which control data CONT indicates the attribute of waveform data and envelope data represented by the header data. E1′ is one of two envelope data. The start address of the other envelope data E2′ is given by STE+ΔSTE. W1 and W2 are two kinds of waveform data. The start address of the waveform data W1 is given by STW+ΔSTW.

Table 17 shows the constitution of the control data CONT. The components of the control data CONT signify the following information.

P/O: Flags for indicating whether a musical tone represented by the header data has a piano type envelope or an organ type envelope. When P/O=1, the musical tone is of a piano type envelope.

ORG: Information of three bits indicating the intrinsic octave range of the musical tone data in question. The correspondence between ORG and octave ranges is shown in Table 18. Thus, ORG is information showing the actual number of samples in one cycle of a waveform data.

W8: Data which indicates whether the accuracy of waveform data is of twelve-bit accuracy or eight-bit accuracy. When W8=1, the accuracy is eight-bit accuracy and four bits of "0" are added to waveform data after the lowest bit to maintain the amplitude level of the wave form.

PCM: When PCM=1, the leading edge of the waveform data W1 is PCM.

NA: A two-bit signal used for superposing a noise signal upon a musical tone signal.

(3) Waveform Data (W1, W2)

Figure 12:
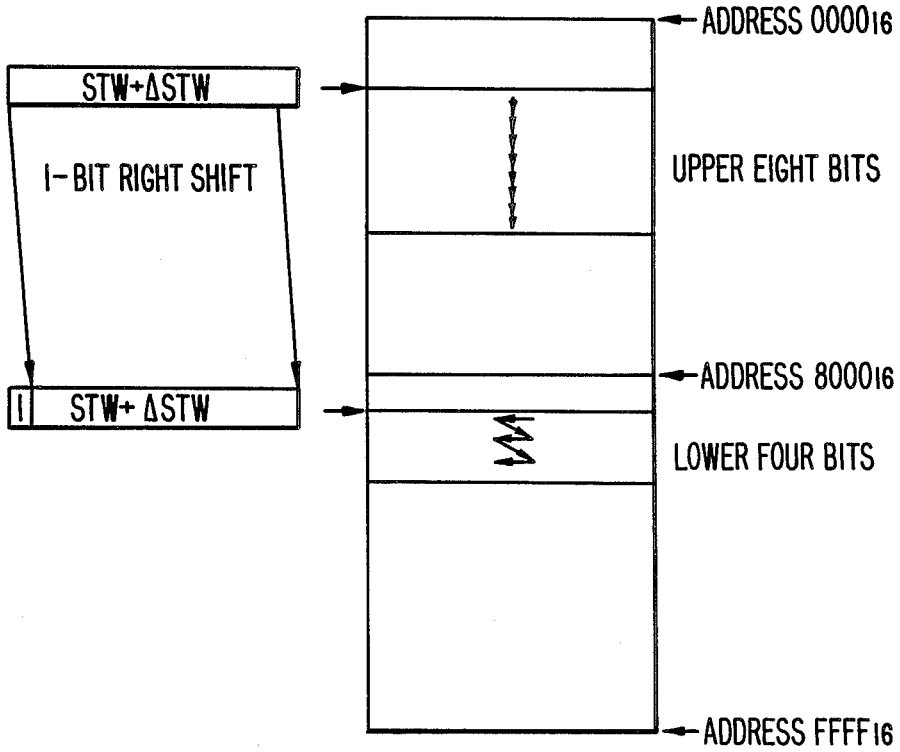
FIG. 12 is a diagram showing the data format of a data bank 1-6.

As mentioned above, the musical tone signal generating unit 1-5 uses two kinds of waveform data, namely, waveform data of twleve bits and waveform data of eight bits. Most commercial ROMs are of eight bits or less and 12-bit ROMs are rarely available. According to the present invention, the following waveform are stored in the ROM as shown in FIG. 12.

8-bit waveforms are stored sequentially one by one in addresses specified by STW and ΔSTW. In storing 12-bit waveform data, the upper eight bits are stored sequentially in an address specified by STW++ΔSTW, while the lower four bits of two words are stored in an address having 1 in MSB specified by shifting the value of STW+ΔSTW by one bit to the right. For example, the location of the lower four bits of the upper eight bits of waveform data in address $0444_{16}$ is the upper four bits of address $1222_{16}$ and, with address $0445_{16}$, the lower four bits of address $1222_{16}$.

(4) Envelope data (E1′,E2′)

Envelope data are 16-bit data. The data format of the envelope data is shown in Table 19. ΔT indicates data for deciding the renewal interval of envelope address, S is a flag which indicates the gradient (increase or decrease) of the envelope, Z is a flag indicating the magnitude of the gradient of the envelope, and DATA is its magnitude. The data shown in Table 19 are stored in the data bank in addresses specified by STE and ΔSTE shown in Table 16.

Since the data bank has the above-mentioned constitution, tone is modulated for every successive three keys. On the other hand, when tones of an octave has the same header address data, a musical tone of the same tone quality can be produced without increasing the waveform data, envelope data and header data. Since each header data can specify optional waveform data and envelope data, various musical tones can be produced through the combination of a reduced number of waveform data and envelope data.

The initial procedure, note clock generating procedure, envelope generating procedure and waveform generating procedure in the musical tone signal generating unit 1-5 upon the depression of the key will be described hereinafter.

(1) Initial Procedure

The registers are initialized when the key is depressed to generate a musical tone signal. Upon the depression of the key, the arithmetic sequence is started from the long sequence of the initial mode, and hence in the adding unit, the PDR is initialized in the time slot 13. With reference to FIG. 5, PDD is read out from the RAM 5-4 and is provided on the bus HE. At the same time, the signal processor 7-6 (FIG. 7) gives PED to the bus HD and the switches SW21 and SW17 are closed to provide PDD and PED on the bus A and the bus B, respectively (FIG. 11*a*). The data are added by the FA 2-6 (FIG. 8) and the result of the calculation is provided on the bus C. The result of calculation is provided through the SW23 on the bus HE and is stored in the register PDR of RAM 5-4. The PDD and PED are transferred one time slot before the time slot in which the calculation: PDD+PED is executed, while the calculated result is stored in the PDR one time after the calculation PDD+PED is executed. Other adding operations are executed in the same manner. Then, in the time slots 15 to 18, "0" is written in the TR1, TR2, ZR1, and ZR2. This operation will be described with reference to writing "0" in the TR1. In the time slot 15, the SW33 and SW13 of MSW 2-11 (FIG. 11*a*) are closed. Since the SW33 has a constitution as shown in FIG. 11*g*, "0" is provided on the bus C. At the same time, since the SW13 is closed, the data provided on the bus C is given to the bus HC and "0" is written in the register TR1 of the RAM 7-3 (FIG. 7).

On the other hand, the data bank reading unit operates in the following manner, which will be described with reference mainly to FIG. 10. The WRD consisting of the TAB, ND and OCT reads the header address data HAD. In the initial mode in which the initial procedure is carried out, the latch 10-3 is set at 111 by the SQ signal. This data is rearranged in the format shown in Table 15 by the shifter 10-13 of the I/O 2-10, and then the data is transmitted through the bus D, the SW15 and the bus HC to and stored in the register HAD of the RAM 7-3. During this operation, the header address data HAD read out from the data bank is latched sequentially by the latches 10-8 and 10-6, is rearranged in the format shown in Table 15 by the shifter selector 10-9 and is latched by the latch 10-4. The bit operation circuit 10-10 gives 000 to the lower three bits of the output of the latch 10-4, and the control data CONT is read out from the data bank 1-6 and is latched through the latch 10-8 by the latch 10-7 in the upper eight bits. The control data CONT is transmitted through the selector 10-12, the shifter 10-13, the noise circuit 10-14, the latch 10-2 and the bus D to and stored in the register CONT of the RAM 5-4. On the other hand, since the upper four bits of the latch 10-7 are connected to the decoder 10-11, data of sixteen bits is obtained from the truth table of Table 14. At this moment, the input C of the decoder 10-11 is "1". The selector 10-12 selects the output of the decoder 10-11, and then the shifter 10-13 shifts the output by six bits to the right and provides an output. The data given from the latch 10-7 to the decoder 10-11 are P/O and ORG three bits. Since the input C of the decoder 10-11 is "1", the output of the decoder 10-11 is dependent only on the ORG three bits. Accordingly, the value shown in Table 18 is obtained by shifting the output of the decoder 10-11 by six bits to the right by the shifter 10-13. This value is provided through the noise circuit 10-14 and the latch 10-2 on the bus D, and then the value is transmitted through the SW15 of the MSW 2-11 to and stored in the register DIF11 of the RAM 7-3.

The bit operation circuit 10-10 gives 001 and then 010 to the lower three bits of the output of the latch 10-4 to read out the upper eight bits and the lower eight bits of the STE of the header. The value of the STE is provided through the selector 10-12, the shifter 10-13, the noise circuit 10-14 and the latch 10-2 on the bus D and is transmitted through the SW5 of the MSW 2-11 to and stored in the register EAR1 of the RAM 7-1.

Then, the short sequence is executed twice. In the time slot 1, PDR and JD are added, in which JD is a constant which is obtained when the SW32 of the MSW 2-11 is closed. Since the SW32 has a constitution as shown in FIG. 11*h*, JD=$45B_{16}$. The result of the addition is multiplied by the note coefficient CN to provide FR. A series of operations is executed in the following manner. In the time slot 1, PER+JD is executed, and then the result of addition is provided on the bus C in the time slot 2. Then, the switches SW28 and SW29 are closed to transfer the data via the bus C→the bus HL→the bus L, and then the data is latched by the latch 9-1 of the MPLY 2-7 (FIG. 9*a*). In the next time slot 3, the value of CN corresponding to the note data ND given by the ROM 7-5 is read out and provided on the bus HD. This value CN is provided through SW19 of the MSW 2-11 on the bus L and is latched by the latch 9-3 of the MPLY 2-7. The output of the latch 9-1 is transmitted through the shifter 9-11 to and latched by the latch 9-2, while the output of the latch 9-3 is transmitted through the bit operation circuit to and latched by the latch 9-4. Consequently, the value of PDR+JD and the value of CN are latched by the latch 9-2 and the latch 9-4, respectively. Then, the multiplier 9-16 calculates the product of (PDR+JD) and CN. The result of multiplication is transmitted through the shifter 9-15 and is latched by the latch 9-8. During a series of these operations, the shifter 9-11, the bit operation circuit 9-12 and the shifter 9-15 operate so as to make the data pass therethrough. That is, the input C of the encoder 9-10 is "1". The value latched by the latch 9-8 is transmitted through the bus L and the SW9 of the MSW 2-11 to and is stored in the register FR of the RAM 7-2. Accordingly, in the time slot 2, ORG+OCT+1 is calculated. In this calculation, the logic gate 8-12 of the FA 2-6 (FIG. 8) perform operation for +1. That is, when the logic gate 8-12 provides "1" forcibly in the relevant time slot, the latch 8-5 latches "1" and "1" is given to the input of the adder Ci. The significance of this operation is as follows. The ORG represents a value (this value is supposed to be N, for example) representing the intrinsic octave range of the wave form data in the inverse logic of the octave data. Tables 18 and 22 show the relationship of waveform sample number of ORG and OCT, respectively. Accordingly, ORG+1 is represented by −N. That is, $$ORG+OCT+1=OCT-N.$$

This value is the difference between the octave range of a musical tone signal to be generated presently and the intrinsic octave range of the waveform data to be used actually, namely, a value representing the amount of octave shift, and hence the value indicates the number of octave intervals between the intrinsic octave range of the original waveform and a higher octave range at which the original wave form is actually read out. This value is stored temporarily in the register WE 2 of the RAM 7-4, and then the value is decoded by the signal processor 7-6 and stored in the register ΔWAR of the RAM 7-2. Table 20 shows the value of ΔWAR corresponding to the values of ORG+OCT+1.

In the time slot 4 and the time slots 6, 8, 9 and 10, the EAR2, and the registers of the WR1, ER1, WE2, WE1 and WR2 are initialized.

On the other hand, in the data bank reading unit, the header address data HAD stored in the RAM 7-3 through the long sequence is read out and the header address data HAD is transmitted through the bus D→the latch 10-1→the shift selector 10-9 to and latched by the latch 10-4, the bit operation circuit 10-10 give 001 to the lower three bits and the ΔSTE of the header data is read out from the data bank. This value is transmitted through the latch 10-7→the selector 10-12→the shifter 1013→the noise circuit 10-14 and the latch 10-2 to the bud D, and then through the SW26 and SW30 of the MSW 2-11 to the bus A. Then, the value is added to EAR1 by the FA 2-6. Then, the STE (the start address of the envelope data E1') stored in the register EAR1 of the RAM 7-1 is read out, and then the STE is transmitted through the bus D→the latch 10-1→the shifter selector 10-9 to and latched by the latch 10-4. The output of the latch 10-4 is processed by the bit operation circuit 10-10 and the bit operation circuit 10-10 gives "0" and then "1" to the LSB. Thus, envelope data of two bytes shown in Table 19 is read out. The sixteen bits of this value is latched by the latch 10-7. According to the output of the latch 10-7, ΔT1, ΔE1 and ΔZ1 are produced in the first short sequence, while ΔT2, ΔE2 and ΔZ2 are produced in the second short sequence. The upper four bits of the latch 10-7 is given to the decoder 10-11. The upper four bits of the latch 10-7 include the value of ΔT shown in Table 19. Therefore, the decoder 10-11 decodes ΔT according to Table 13 and gives the decoded result to the selector 10-12. Then, the selector 10-12 becomes C=1 and selects the input B and gives the same to the shifter 10-13. The output of the selector 10-12 is not subjected to any bit operation in the shifter 10-13 and the noise circuit 10-14 and is provided through the latch 10-2 on the bus D, and then the output of the selector 10-12 is transmitted through the SW10 of the MSW 2-11 and the bus HD to and stored in the register ΔT1 of the RAM 7-2.

Figure 13:
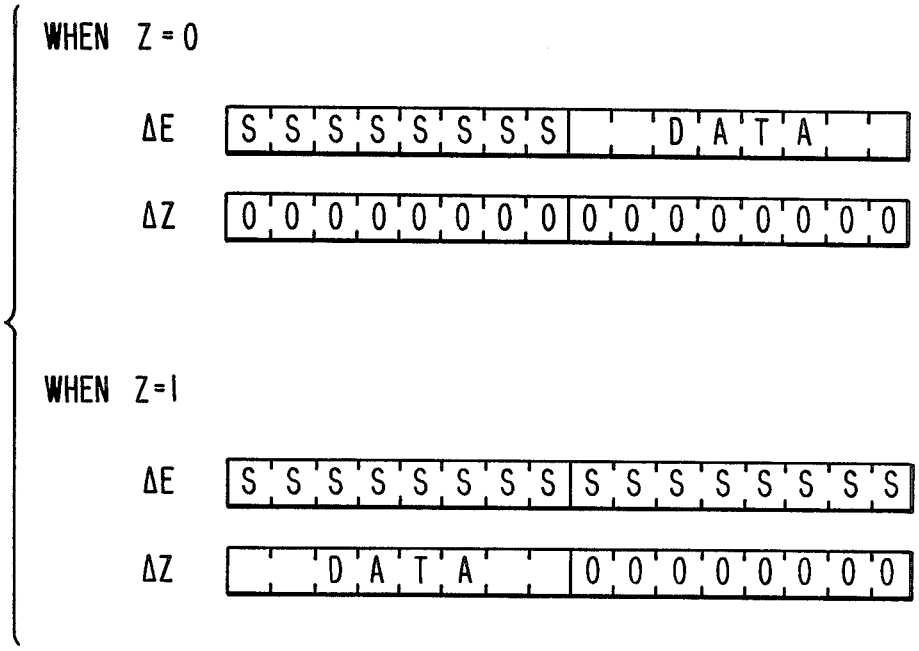
FIG. 13 is a diagram showing the data format of the envelope data of the data bank 1-6.

ΔE1, ΔZ1, ΔE2 and ΔZ2 are subjected to bit operation in the shifter 10-13 according to Z, S and DATA shown in Table 19, and then the operation values are stored to the corresponding registers. The manner of the bit operation is shown in FIG. 13. The data format is dependent on the value of Z shown in Table 19.

The value stored in the register HAD of the RAM 7-3 is read out, similarly to reading out ΔSTE from the data bank 1-6, and the value is latched by the latch 10-4. In the first initial mode, 100 and then 101 are given to the lower three bits of the header address data HAD in the bit operation circuit 10-10, and then in the second initial mode, 110 and then 111 are given to the lower three bits of the header address data HAD to read out STW and ΔSTW from the data bank 1-6. STW and ΔSTW are stored in the register STW of the RAM 7-3 and in the register WAR of the RAM 7-1, respectively.

(2) Note Clock Signal Generating Procedure

Figure 3:
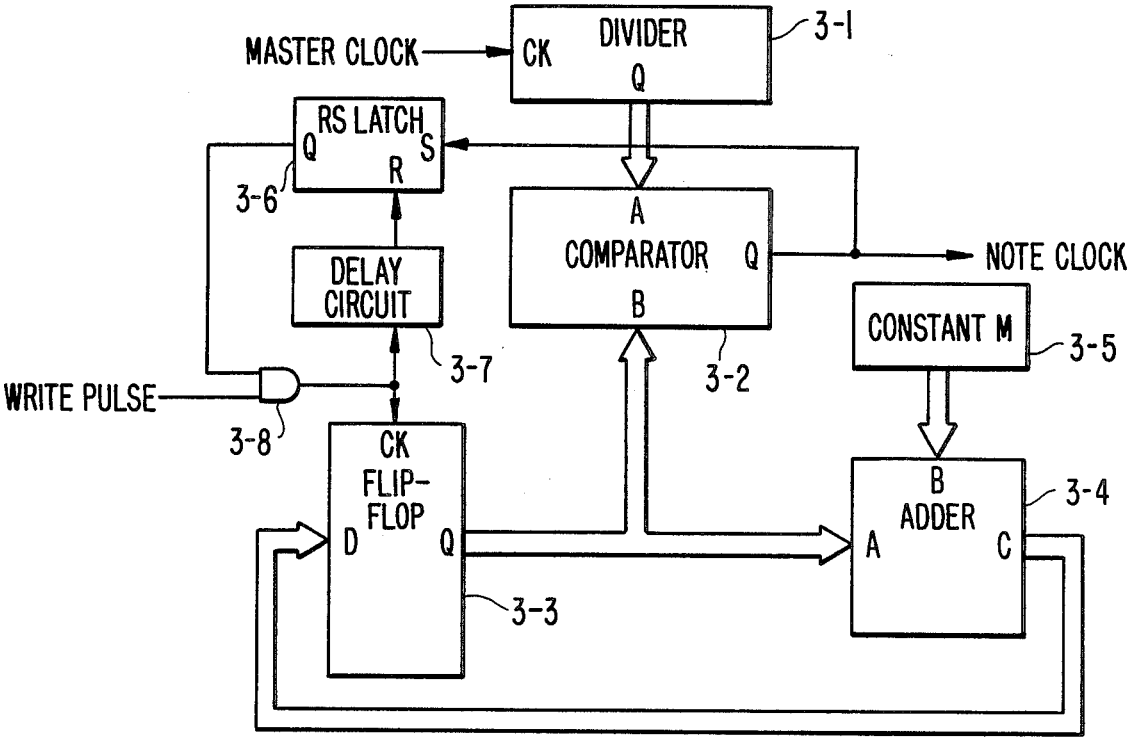
FIG. 3 is a block diagram showing the principle of note clock pulse generation of the musical tone signal generating unit 1-5.

The principle of the note clock signal generating procedure employed in the musical tone generating unit 1-5 will be described with reference to FIG. 3. A divider 3-1 divides a master clock signal given to the terminal CK and provides a divided output of 10 bits from a terminal Q. A comparator 3-2 compares an input A and an input B, and when A=B, provides "1" from a terminal Q. A flip-flop 3-3 receives a signal through an input terminal D at the leading edge of the input CK and provides a signal from a terminal Q. An adder 3-4 adds an input A and an input B and provides the sum from a terminal C. A constant circuit 3-5 gives a contant M to the input terminal B of the adder 3-4. Indicated at 3-6 is an RS latch. When a positive pulse is given to the input terminal S or to the input terminal R, the RS latch becomes Q=1 or Q=Q, respectively. A delay circuit 3-7 holds an input signal and provides the input signal after a time lag. Indicated at 3-8 is an AND gate.

In operation, suppose that the output Q of the RS latch 3-6 is "0", since the output of the AND gate 3-8 is always "0", the output Q of the flip flop 3-3 is constant. On the other hand, the divider 3-1 divides the master clock signal and provides an output Q of ten bits including the repetition of $000_{16}$ to $3FF_{16}$. If the output of the flip flop 3-3 is N, $000_{16} \geqq N \geqq 3FF_{16}$. Therefore, there arrives necessarily a moment where the output Q of the divider 3-1 is N. At this moment, the comparator 3-2 provides a coincidence pulse signal from the output Q thereof. Upon the reception of the coincidence pulse signal through the input terminal S, the RS latch 3-6 becomes Q=1, and the AND gate 3-8 provides a write pulse signal. Since the output C of the adder 3-4 is fed to the input terminal D of the flip flop 3-3, the value of N+M is registered. At the same time, the write pulse signal, after being delayed by the delay circuit 3-7, changes the output Q of the RS latch 3-6 into "0". Consequently, the output Q of the flip flop 3-3 becomes constant again, whereas the value is changed from N to N+M. Accordingly, the next coincidence pulse signal is provided when the output Q of the divider 3-1 becomes N+M. A series of these procedures are repeated and the comparator 3-2 pulse signals when the output of the divider 3-1 is N, N'M, N+2M, . . . . That is, the one coincidence pulse signal is provided for every M counts of the master clock pulse signals counted by the divider 3-1. When $N+nM>3FF_{16}$, the output of the adder 3-4 overflows, and then the output of the same becomes $N+nM-3FF_{16}$. Accordingly, the coincidence pulse signal is generated likewise when the master clock signal is counted M times. Thus, various note clock signals can be generated by varying the constant M employing the coincidence pulse signal of the comparator 3-2 as a note clock signal. The frequency of the note clock signal is (the frequency of the master clock signal)÷M. The output Q of the RS latch 3-6 corresponds to the calculation request flag CLRQ.

The arithmetic sequences of the musical tone signal generating unit 1-5 of FIG. 1 for generating the note clock signal will be described in detail hereinafter.

Upon the depression of a key of the keyboard 1-1, the microprocessor 1-4 instructs the musical tone signal generating unit 1-5 to generate a musical tone signal corresponding to the key. Then, the the long sequence/initial mode of the arithmetic sequence starts to execute $$PDD+PED \rightarrow PDR \quad (2\text{-}1)$$

in the time slot 13, and then the short sequence starts to execute $$PDR+JD \rightarrow L.B. \quad (2\text{-}2)$$

$$C.B. \times CN \rightarrow FR \quad (2\text{-}3)$$

in the time slots 1 to 6. Then, the mode is mode is changed into the normal mode and $$FR+CDR \rightarrow FR \quad (2\text{-}4)$$

is implemented in the time slot 9 of the short sequence and $$PDR+JD \rightarrow L.B. \quad (2\text{-}5)$$

$$C.B. \times CN \rightarrow FR \quad (2\text{-}6)$$

$$PDD+PED \rightarrow PDR \quad (2\text{-}7)$$

are implemented in the time slots 14 to 18 of the long sequence. PDD is the pitch tune data PDD shown in Table 1. PED is the pitch extend data, JD is a constant, namely, $1115_{10}$ (a hexadecimal 45B) herein, and the note coefficient CN is a value corresponding to a note assigned. The relation of tones to CNs is shown in Table 7. As explained with reference to Tables 5 and 6, the operations (2-2), (2-3), (2-5) and (2-6) are expressed by $$(PDR+JD) \times CN \rightarrow FR \quad (2\text{-}8)$$

Since $PDR=PDD+PED$, substituting the PDR of Expression (2-8) by PDD+PED, $$(PDD+PED+JD)\times CN \rightarrow FR \quad (2\text{-}9)$$

As indicated by Expression (2-4), the value of FR is accumulated in CDR. As mentioned above, the accumulation is implemented once every one note clock pulse signal. Accordingly, when the initial value of the CDR is N, the value of the CDR changes from N, to N+FR, N+2FR, N+3FR, . . . . When the value of the upper ten bits of the value of the CDR coincides with a ten-bit divided signal obtained by sequentially dividing the master clock signal, a coincidence pulse signal is generated. Therefore, actually, N/8, (N+FR)/8, (N+2FR)/8, . . . are compared with the ten-bit divided signal. Hence, the upper ten bits of the CDR correspond to the flip flop 3-3 of FIG. 3, and FR/8 corresponds to the value M of the constant circuit 3-5 of FIG. 3. Accordingly, a note clock signal of a fixed period is obtained through the implementation of Expressions (2-1) to (2-7), and the frequency of the note clock thus obtained is N/8, N÷FR/8, N÷2×FR/8, . . . (the frequency of the master clock signal)÷FR/8.

(3) Waveform Generating Procedure

The waveform generating procedure to be carried out by the musical tone signal generating unit 1-5 comprises the following five steps.

(1) Address Generation

An address for reading out waveform data from the data bank 1-6 is generated.

(2) Waveform Reading

Waveform date specified by the address generated in 1) is read out from the data bank 1-6, and then the waveform data is subjected to bit operation according to the control data CONT.

(3) Envelope Multiplication (4) Mixing two waveforms (5) CN multiplication

These steps will be described further in detal hereinafter.

(1) Address Generation

Upon the depression of a key, initialization is performed to store the STW (the start address of W2) of the header data, ΔSTW (the number of words of W1) and DIF1 (the number of samples in one waveform) in the registers STW, WAR and DIF1, respectively, and the register ΔWAR is decided through operation. In the normal mode, an addrress is generated on the basis of these data. The following process is carried out in different ways for waveform data having a PCM part (PCM=1) and for waveform data not having a PCM part (PCM=0).

Waveform Data not Having a PCM Part:

As shown in Table 6, the sum of STW and WAR is obtained in the time slot 2 and a waveform 1 is read out from the data bank 1-6 with the sum, and then a waveform 2 is read out from the data bank 1-6 with a value obtained by adding DIF1 and the sum, namely, the value of STW+WAR+DIF1, in the time slot 4. STW is the top address of the waveform 2 and WAR has ΔSTW, namely, the negative number of the word number included in the waveform 1, as an initial value. In the time slot 7, ΔWAR is accumulated. Accordingly, the value of STW+WAR increases sequentially from the top address of the waveform 1 for every value of ΔWAR. Therefore, the value of STW+WAR+DIF1 increases from the top address of the waveform 2 for every value of ΔWAR. ΔWAR is a value which indicates skipping reading the waveform, and hence addresses for the waveform 1 and the waveform 2 can be generated.

When the waveform data does not have a PCM part, solo flag SOL=0 and octave shift is not performed, the musical tone signal generator 1-5 carries out phase matching. Phase matching is carried out in the following procedure. In the first time slot 7 after the arithmetic sequence has been changed from the initial mode into the normal mode, nine-bit data addressed by the same note in the RAM 8-13 is stored in WAR as the result of operation. Although the output of the RAM 8-13 is nine-bit data, "1" is given to the upper seven bits of the nine bits of the sixteen bits, because the bus C is precharged. The results of the second operation and thereafter in the time slot 7 are stored in WAR as shown in Table 6 and are renewed in a register addressed by the same note in the RAM 8-13. Thus, even if a musical note signal of the same note is generated in another channel, the value of the register WAR in the channel is fed through the RAM 8-13 to the register WAR of the channel in which the musical note signal is to be generated; therefore, phase matching between these two channels is achieved.

The calculation WAR+ΔWAR in the time slot 7 will be described hereunder.

When $WAR+\Delta WAR \geqq 0$, $-512_{10}(FF00_{16})$ is provided on the bus C as the result of calculation, regardless of octave range. When octave shift is not performed, ΔWAR=1, and hence the value of the register WAR is repeated at a period of 512.

Thus, the registers WARs of a plurality of channels which generate the same note are always the same. Therefore, the phases of the same notes generated in different channels are matched completely, and thereby phase matching is achieved.

Further details of the calculation STW+WAR in the time slot 2 will be described hereinafter.

Data is read out from the register STW of the RAM 7-3. The read data is transmitted through the bus HC, the SW11 and the bus A to and latched by the latch 8-1 of the FA 2-6 at the clock signal $\phi$3. At the same time, the value of the register WAR of the RAM 7-1 is transmitted through the bus HA, the SW2 and the bus B to and latched by the latch 8-2 of the FA 2-6 at the clock signal $\phi$3. The output of the latch 8-1 is transmitted to and latched by the latch 8-3 at the clock signal $\phi$1 without being subjected to any bit operation in the bit operation circuit 8-10. On the other hand, the output of the latch 8-2 is subjected to bit operation in the bit operation circuit 8-11 as shown in Table 21 by using an input ORG, and then the operated data is latched by the latch 8-4 at the clock signal $\phi$1. The adder 8-9 adds the outputs of the latches 8-3 and 8-4, and then the sum is provided through the latches 8-7 and 8-8 on the bus C. Although the contents of the register WAR varies at a period of 512, the above-mentioned bit operation of the bit operation circuit 8-11 causes the contents of the register WAR to vary at a period corresponding to the octave. For example, when ORG=5 and OCT=2, octave shift is not performed as described with reference to initializing procedure and ΔWAR=1. From Table 21, since the bits 7 and 8 of the WAR are always "1", when STW'=0, the result of calculation in the time slot 2 is −10, −9, . . . −1, −128, −127, . . . −1, −128 . . . . Thus, the period is 128. When ORG=4 and OCT=5, octave shift of two octaves is performed and ΔWAR=4. From Table 21, since the bits 6, 7 and 8 of the WAR are always "1", the result of calculation is −40, . . . −8, −4, −64, −60, −56 . . . −4, −64, and hence the period is 16.

The fact that the period of repetition is 128 when OCT=2 and 16 when OCT=5 indicates that a desired waveform point is obtained from Table 22. The fact that the WAR increases at a step of 4 when ORG=4 and OCT=5 indicates as shown in Table 18 that the octave of the intrinsic waveform data can be raised by two octaves by obtaining data of sixty-four samples at every four samples.

Waveform Data Having a PCM Part:

Addressing for waveform data having a PCM part is the same as that for waveform data not having a PCM part, except that the operation in the time slot 2 for the waveform data having a PCM part is different from that for the waveform data not having a PCM part.

In the time slot 2, a calculation of STR+WAR is carried out. That is, data is read out from the register STW of the RAM 7-3, and then the data is transmitted through the bus HC, the SW11 and the bus A to and latched by the latch 8-1 of the FA 2-6 at the clock signal 3. At the same time, the value of the register WAR of the RAM 7-1 is transmitted through the bus HA, the SW2 and the bus B to and latched by the latch 8-2 of the FA 2-6. The output of the latch 8-1 is given to the bit operation circuit 8-10, while the output of the latch 8-2 is given to the bit operation circuit 8-11. However, both the outputs are fed to the latch 8-3 and the latch 8-4, respectively, without being subjected to bit operation, and then the outputs are added by the adder 8-9.

As regards the value of the register WAR, when a PCM part is not included, the negative number of the number of samples contained in one period of the waveform is written in the register WAR as the initial value whereas, when a PCM part is included, the negative number of the number of all the samples of the waveform used as a PCM part is written in the register WAR as the initial value. Accordingly, the result of calculation in the time slot 2 corresponds to a value increased by an increment of ΔWAR from the top address of the PCM part of the waveform 1 in the data bank 1-6. The end of the PCM part is detected by detecting $WAR+\Delta WAR \geqq 0$ in the time slot 7. The procedure for generating an address after the end of the PCM part is the same as that for waveform data not having a PCM part; the outputs of the latches are subjected to bit operation in the bit operation circuit 8-11.

The address operation in the musical tone signal generating unit 1-5 is sixteen bits, however, an address signal of sixteen bits may not be sufficient. The musical tone signal generting unit 1-5 of the present invention is capable of expanding the address space by using the upper three bits of the tablet data TAB. The latch 10-3 of the I/O 2-10 is used for expandiang the address space. The latch 10-3 latches the upper three bits of the tablet data TAB.

Upon the depression of a key, the initial mode is established. Then, tablet data stored in the RAM 5-4 is transmitted through the MSW 2-11 to and stored in the register TAB' of the RAM 7-3. In the successive normal mode, the value of the register TAB' of the RAM 7-3 is read out and is transmitted through the MSW 2-11 to and latched by the latch 10-3 of the I/O 2-10. Thus, although the internal operation is for sixteen bits, an address space of nineteen bits is available.

(2) Waveform Reading

A waveform form reading operation is carried out on the basis of the address produced through operation in the time slots 2 and 4. The result of operation in the time slot 2 is transmitted through the bus C the SW28, the bus HL, the SW30 and the bus D to and is latched by the latch 10-1 of the I/O 2-10. The output of the latch 10-1 is transmitted through the shifter selector 10-9, the latch 10-4 and the bit operation circuit 10-10 to and is latched by the latch 10-5. The output latched by the latch 10-5 reads the data bank 1-6 together with the data latched by the latch 10-3. The output of the data bank 1-6 is latched by the latch 10-8. Then, the output of the data bank 1-6 is shifted to the right by one bit by the shifter selector 10-9, "1" is given to the MSB and the sum is latched by the latch 10-4. The output of the latch 10-4 is transmitted through the bit operation circuit 10-10 to and is latched by the latch 10-5. The data latched by the latch 10-5 reads the data bank 1-6 together with the data latched by the latch 10-3. Then, the output of the data bank 1-6 is latched by the latch 10-7. Since the output of the latch 10-8 is given to the upper eight bits of the latch 10-7, the data of the latch 10-7 is latched together with the former output of the data bank 1-6. The data latched in the lower eight bits of the latch 10-7 corresponds to the respective lower four bits of two waveforms as is explained above regarding the data bank. The output of the latch 10-7 is given through the selector 10-12 to the shifter 10-13; the upper eight bits of the output is shifted to the right by four bits. When the output of the latch 10-1 is LSB=0, the lower eight bits also are shifted to the right by four bits, when LSB=1, the output of the latch 10-7 is given through the shifter 10-13 to the noise circuit 10-14 without the lower four bits being shifted. When the control data CONT specifies a 8-bit wave form, namely, W8=1, the lower four bits of the output of the shifter are "0". The output of the shifter 10-13 is provided through the noise circuit 10-14 and the latch 10-2 on the bus D, and then the output is transmitted through the MSW 2-11 to and is stored in the register WR1 of the RAM 7-3. This value is the waveform data of the waveform 1 and corresponds to the W1 shown in FIG. 14.

The address decided through the operation implemented in the time slot 4 is subjected to the same process, except that a noise signal is added in the noise circuit 10-14 when NA≠00 in the control data CONT. When NA=01, NA=10 or NA=11, the bit 9, the bit 10, or bits 9 and 10 are replaced by the noise signal. Thus, the noise signal is superposed on the waveform data without using any adder. The value thus obtained is stored in the register WR2 of the RAM 7-2 as the waveform data of the waveform 2, which is a periodic waveform corresponding to the W2 shown in FIG. 14.

(3) Envelope Multiplication

The two kinds of waveforms 1 and 2 thus obtained are subjected to envelope multiplication (the envelope generating procedure will be described later). The envelope for the waveform 1 are stored in the register ER1 of the RAM 7-3 and in the register ER2 of the RAM 7-3, respectively (E1 and E2 in FIG. 14). The envelope is data consisting of 4-bit exponential part and 9-bit fixed point part in the floating point representation. The envelope multiplication is implemented twice for each channel in the same manner, hence only the operation for WR1×ER1 in the time slots 7 to 9 will be described.

The data of the register ER1 of the RAM 7-3 is transmitted through the MSW 2-11 to and is latched by the latches 9-3 and 9-5 of the MPLY 2-7. The lower ten bits of the data of the ER1 are latched by the latch 9-3, while the upper four bits of the same are latched by the latch 9-5. Then, the data of the register WR1 of the RAM 7-3 is transmitted through the MSW 2-11 to and is latched by the latch 9-1 of the MPLY 2-7. The MSB of the output of the latch 9-3 is set at "1" by the bit operation circuit 9-12 and the output is latched by the latch 9-4. Thus, the fixed point part of the envelope is latched by the latch 9-4. The output of the latch 9-1 is transmitted through the shifter 9-11 to and is latched by the latch 9-2. To the input terminal C of the encoder 9-10, 1 is given by the SQ signal, while 00001 is given to the input terminal C of the shifter 9-11. Accordingly, the shifter 9-11 feeds the lower twelve bits of the output of the latch 9-1, namely, the waveform data of twelve bits of the waveform 1 read from the data bank 1-6, to the latch 9-2. The multiplier 9-16 multiplies the data of the latch 9-2 by the data of the latch 9-4. The 14-bit product is latched by the latch 9-7 and fed to the shifter 9-15.

On the other hand, the exponential part of the envelope latched by the latch 9-5 is transmitted through the latch 9-6 to the decoder 9-13, where the exponential part is decoded. The decoded signal is given through the selector 9-14 to the shifter 9-15 as a control signal. Accordingly, the output of the latch 9-7 is shifted by the exponential part of the envelope and is latched by the latch 9-8. Thus the waveform data of fixed point representation is multiplied by the envelope data of floating point representation. The output of the latch 9-8 is transmitted through the bus L and the MSW 2-11 to and is stored in the register WE1 of the RAM 7-1 (W1 and E1 in FIG. 14). The waveform data and the envelope data of the waveform 2 are processed through the similar procedures and the result is stored in the register WE2 of the RAM 7-4 (W2 and E2 in FIG. 14).

(4) Mixing Two Waveforms

Figure 14:
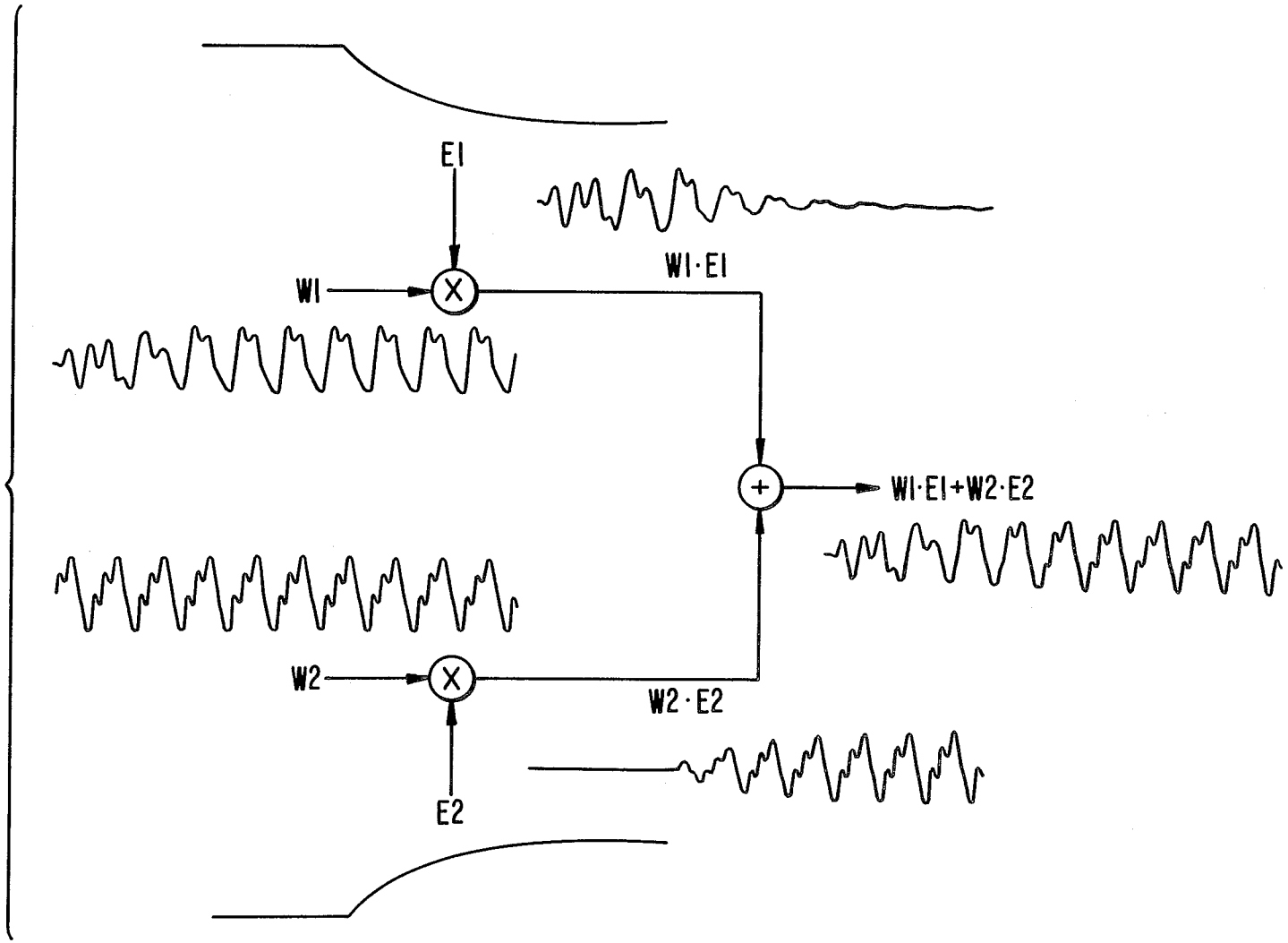
FIG. 14 is a wave form chart showing the wave form of a musical tone signal provided by the electronic musical instrument according to the present invention.
Figure 15:
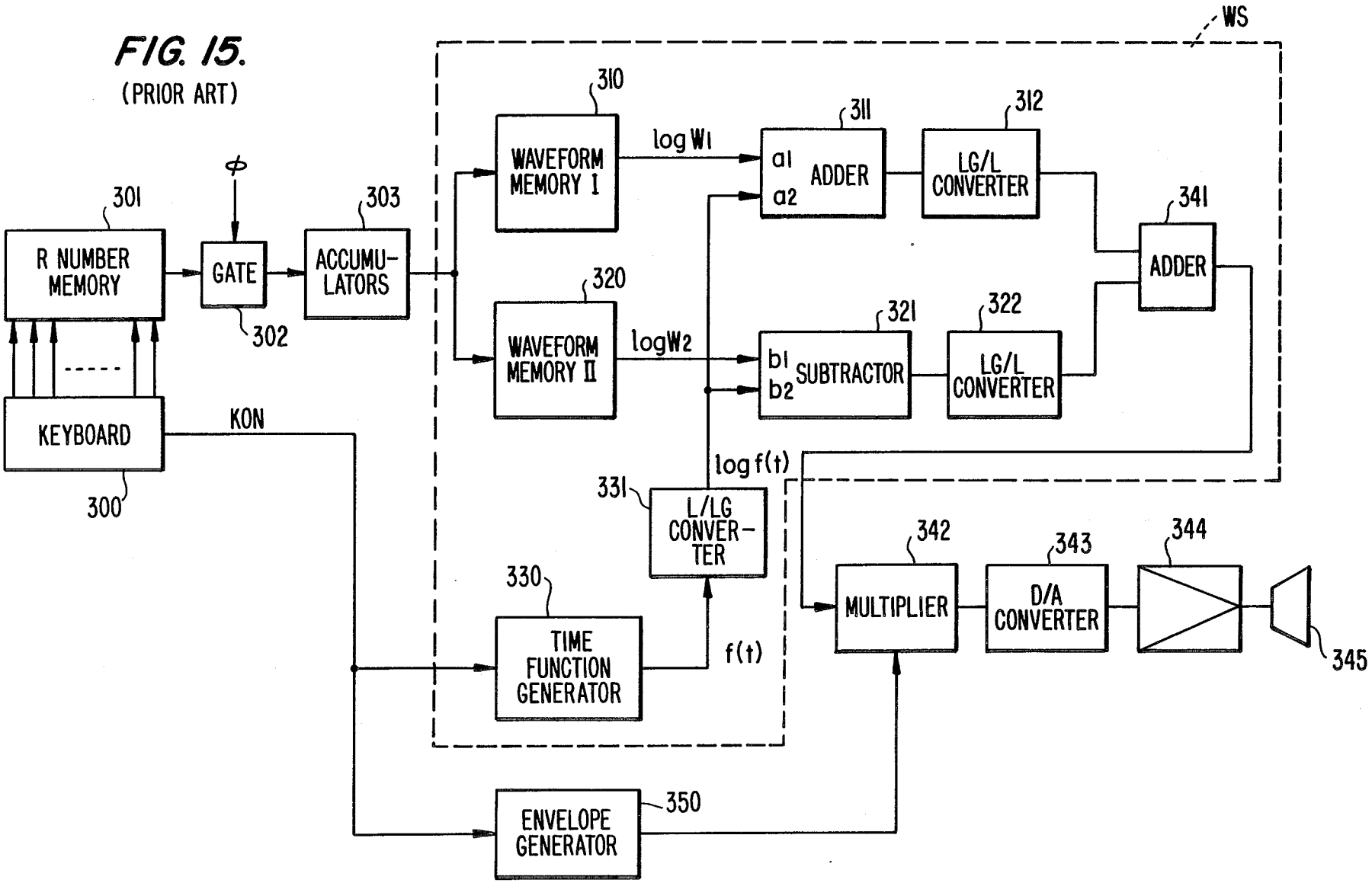
FIG. 15. (PRIOR ART)
FIG. 15 is a block diagram of a conventional electronic musical instrument.

In order to mix two waveforms, the contents of the registers WE1 and WE2 are added (W1.E1+W2.E2 in FIG. 14). This addition corresponds to the operation in the time slot 1.

(5) CN Multiplication

Two waveforms are mixed in the time slot 1. In generating a musical tone signal by the musical tone signal generating unit 1-5 of the present invention, in some cases, sound pressure level varies between notes due to the characteristics of the ABM 2-9 and the filter 1-7, and hence the musical tone signal is corrected through CN multiplication. The note coefficient is employed as a coefficient for correction. The result of the operation WE2+WE1 in the time slot 1 is transmitted through the bus C, the SW 28, the bus HL, the SW29 and the bus L to and is latched by the latch 9-1 of the MPLY 2-7. On the other hand, a note coefficient corresponding to the note data ND is read out from the ROM 7-5 of the memory 2-5. The read note coefficient is transmitted through the bus HD, the SW24 and the bus L to and is latched by the latch 9-3 of the MPLY 2-7.

Since WE1+WE2 is 16-bit data and an input at the input terminal A of the multiplier 9-16 needs to be 12-bit data, the following process is implemented by the MPLY 2-7. The upper five bits of the data of the latch 9-1 is fed to the encoder 9-10, and the encoder 9-10 provides data as shown in Table 9 through the terminals A and B thereof. That is, the substantial bit number of the data latched by the latch 9-1 is obtained and twelve bits are fetched from the latch 9-1 by the shifter 9-11. For example, When the data latched by the latch 9-1 is $3A26_{16}$, the substantial bit number of the data is fifteen, and hence the shifter 9-11 fetches twelve bits below the bit 14 of the latch 9-1 and provides an output of $744_{16}$. Thus, the substantial part of WE1+WE2 is multiplied by the note coefficient, and then the bit number of the product is restored to the original bit number and the product is latched by the latch 9-9. Thus, the multiplication of data having a large bit number is achieved by a multiplier of small bit capacity.

The valve thus obtained is given to the DAC 2-8, and then the period of the value is corrected to a predetermined period by the ABM 2-9 to provide a musical tone signal.

The musical tone signal generating unit 1-5 of the present invention is capable, as mentioned above, of changing the CN multiplication for VLD multiplication by the flag VOL of Table 1 by the instruction of the microprocessor. In the long sequence, the 8-bit data of the register VLD of the RAM 5-6 is fed through the MSW 2-11 to the register VLD' of the RAM 7-4. In the MSW 2-11, the 8-bit data is subjected to bit shift operation; the 8-bit data is shifted by two bits to the left and "0" are added to the lower two bits to convert the 8-bit data into 10-bit data, and thereby the bit number of the bit number of the data of the VLD becomes equal to the bit number of CN. Whether the value of WE1+WE2 is multiplied by the data of the ROM 7-5 or the same is multiplied by the data of the register VLD' is decided by the flag VOL of Table 1; when VOL=0, the ROM 7-5 provides data on the bus HD, and, when VOL=1, the RAM 7-4 provides data on the bus HD.

Thus, the microprocessor 1-4 is able to control the level of the musical tone signal generated by the musical tone signal generating unit 1-5. Amplitude modulation is achieved by sequentially changing the value of the VLD of Table 1.

When the VLD is produced on the basis of either key depressing speed or key depressing pressure, the musical tone signal generating unit is capable of touch response function. Touch response function is an operation to vary the volume and tone of sound according to the speed and intensity of keyboard operation. The piano, for example, emits intense and vivid sound when the notes are struck intensely and, on the contrary, the piano emits weak and damp sound when the notes are stuck faintly. Thus, the volume and tone of the sound of the piano can be controlled at will by varying the intensity of striking the notes; however, the tone quality of the declining sound can not be changed even if the pressure on the notes is changed after striking the notes. Accordingly, with the piano, touch response function is related only to the intensity of striking the notes. Such touch response function is designated as initial touch control. Generally, initial touch control is effective for percussion instruments.

With the trumpet, the tone quality of a continuous sound can be varied by varying the breath. Therefore, in simulating the sound of the trumpet by operating the keyboard of an electronic musical instrument, it is necessary to vary the volume and tone of the sound by controlling the depression of the keys. Such a function is designated as after-touch control. Generally, after-touch control is effective for wind instruments and string instruments.

As mentioned in the foregoing description, the embodiment of the present invention is capable of control the sound volumes of the individual channels through the VLD multiplication using VOL flags. In application, the key striking intensity is measured, and the value of VLD is decided according to the measurement by the microprocessor, and then the volume of each note corresponding to the struck key is controlled according to the value of VLD.

As apparent from the foregoing description of the function of the musical tone signal generating unit, the musical tone signal generating unit of the present invention is capable of varying both the volume and tone of sound according to the value of VLD by making the the microprocessor provide the VLD by changing the tablet data according to the value of VLD.

A tone changing operation will be described with reference to an example, in which the VLD is 8-bit data.

Table 23 shows the ranges of the values of VLD and the corresponding accent marks and tablets.

Sound volume is reduced by half, namely, 6 dB, for every decrement of one bit in VLD. The levels of sound volume are assigned to musical accents, respectively. A plurality of wave form data are stored in the data bank. Since the musical accent ff requires vivid tone, waveform data having abundant harmonics is assigned to tablet O and, since the musical accent mp requires soft tone, nearly sinusoidal waveform data is assigned to tablet 3. Thus, it is possible to select one tone from among four kinds of tones within the range of value of VLD by controlling key striking force and 256 sound levels are available according to an 8-bit VLD. Thus, initial touch control is achieved.

The musical tone signal generating unit according to the present invention is capable of continuously varying the tone and volume of sound according to the variation of pressure on the key after the key has been struck, by making the microprocessor provide tablet data corresponding to the value of VLD continuously varying according to the pressure applied to the key after striking the key. Thus, aftertouch control is achieved.

(4) Envelope Generating Procedure

Envelope generating procedures in the musical tone signal generating unit 1-5 are carried out in the following three steps:

(1) Address generation,
(2) Envelope data reading, and
(3) Envelope calculation.

These steps will be described in detail hereinafter.

(1) Address Generation

Upon the depression of a key, the registers EAR1, EAR2, TR1, TR2, ΔT1 and ΔT2 are initialized on the basis of STE of the header data (start address of envelope data E1') and ΔSTE (word number of envelope data E1'). Address calculation is executed on the basis of these data. Since the frequency of address calculation is small, the long sequence is employed. The address of envelope data E1' and the address of envelope data E1' are calculated in the ODD/long sequence and EVEN/-long sequence, respectively.

In the ODD/long sequence, operation is implemented for $$\Delta T1 + TR1 \rightarrow TR1 \quad (4\text{-}1)$$

in the time slot 13, and $$\Delta EAR1 + EAR1 + Ci \rightarrow EAR1 \quad (4\text{-}2)$$

in the stime slot 15. Data is read out from the data bank 1-6 by using the value of EAR1. The Ci in the time slot 15 corresponds to an overflow resulting from the accumulation of ΔT1 in the time slot 13.

With particular regards to (4-1), the data of the register ΔT1 of the RAM 7-2 is transmitted through the bus HB and the MSW 2-11 to and is latched by the latch 8-1, while the data of the register TR1 of the RAM 7-3 is transmitted through the bus HC and the MSW 2-11 to and is latched by the latch 8-2 of the FA 2-6. The bit 3 of the output of the latch 8-1 is set forcibly at "0" (the reason for forcibly setting the bit 3 at "0" will be described later) by the bit operation circuit 8-10, and the thus operated output of the latch 8-1 is latched by the latch 8-3. The output of the latch 8-2 is transmitted through the bit operation circuit 11 without being subjected to any operation such as bit conversion to and latched by the latch 8-4. The respective outputs of the latches 8-3 and 8-4 are added by the adder 8-9, and then the sum of the addition is provided through the latch 8-8 on the bus C and transmitted through the MSW 2-11 to and is stored in the register TR1 of the RAM 7-3. When there is any overflow in the result of the addition, the adder 8-9 provides "1" through the Co thereof. This output of the adder 8-9 is latched by the latch 8-6 for operation in the time slot 15. These procedures are for waveform data not having PCM part. When the waveform data has PCM part (flag PCM=1), "0" is given forcibly to the register TR1 as the result of the addition until the end of reading the PCM part. Accordingly, overflow does not occur in the accumulation of ΔT1, therefore, the value of EAR1 is not renewed until the end of reading the PCM part. As explained with reference to initialization procedure, ΔT1 is the value of D output when C=0 shown in Table 13. Since the TR1 is a 16-bit register, when $\Delta T1 = 4000_{16}$, for instance, the register TR1 overflows when the operation (4-1) is repeated four times and Ci=1 in operation (4-2), so that the address is renewed. Operations (4-1) and (4-2) are executed once in two long sequences. As shown in FIG. 1c, since the period of recurrence of the long sequence corresponds to 388 time slots and the period of each time slot is 250 ns, the long sequence appears at every 194 μs. Therefore, the operations (4-1) and (4-2) are executed at every 194 μs and, when $\Delta T1 = 4000_{16}$, the address is renewed at every 776 μs.

Since the envelope data is 2-byte data, two addresses needs to be renewed at a time. Address renewal is performed in the time slot 15 in the following procedures.

The value of ΔEAR1 is dependent on ΔT1; when $\Delta T1 \neq 0008_{16}$, $\Delta EAR1 = 0000_{16}$ and, when $\Delta T1 = 0008_{16}$, $\Delta EAR1 = FFEB_{16} = -21_{10}$. This operation is executed by the SW31 of the MSW 2-11. The SW31 has a constitution as shown in FIG. **11*i* and controls the connection by a flag TO indicating the value of the bit 3 of ΔT1. Suppose that $\Delta T1 \neq 0008_{16}$. Then, the SW31 provides $0000_{16}$ on the bus A, and the EAR1 provides its data through the bus A and the SW2 of the MSW 2-11 on the bus B. These data are latched by the latches 8-1 and 8-2 of the FA 2-6. The output of the latch 8-1 is given through the bit operation circuit 8-10 to the latch 8-3, in which the output is not subjected to any data conversion in the bit operation circuit 8-10. On the other hand, the output of the latch 8-2 is fed to the bit operation circuit 8-11, where the LSB of the data is set forcibly at "1", and then the bit operation circuit 8-11 give an output to the latch 8-4. That is, the bit operation circuit 8-11 adds 1 beforehand to the output of the latch 8-2. The overflow of the operation (4-1) stored in the latch 8-6 is latched by the latch 8-5. Accordingly, when the data latched by the latches 8-3, 8-4 and 8-5 are added and when the data of the latch 8-5 is "1", "2" is added to the data of EAR1. On the other hand, when the data of the latch 8-5 is "0", the data of the EAR1 is increased by 1. however, since the I/O 2-10** gives "0" or "1" forcibly to the LSB, any problem does not occur.

When $\Delta T1=0008_{16}$, $\Delta EAR1=FFEB_{16}(-21_{10})$. Accordingly, $21_{10}$ is subtracted from the value of EAR1, and hence envelope data ten words before is read. Consequently, the address of the envelope data is looped, and thereby a repetitive envelope, such as that of mandolins can be generated. The reason for setting the bit 3 at "0" through the operation (4-1) in the bit operation circuit 8-10 is that the bit 3 is a bit for establishing $\Delta EAR1=FFEB_{16}$ and the addition of $0008_{16}$ should to the register TR1 needs to be inhibited in the operation.

The operation of ΔT2, TR2, ΔEAR2 and EAR2 in the EVEN/long sequnece is performed in the similar manner. Since operation relating to EAR1 and EAR2 is executed independently, entirely different envelope signals are generated for the waveform 1 and the waveform 2, respectively. The period of repitition of the EAR1 or EAR2 can be easily varied, and thereby various effects can be produced.

(2) Envelope Reading

Envelope data reading is executed in the long sequence; envelope data for the waveform 1 is read in the EVEN/long sequence, while envelope data for the waveform 2 is read in the ODD/long sequence. Procedures for reading envelope data on the basis of the data stored in the registers EAR1 and EAR2 are the same as those described with reference to initializing process; the format of the data read out from the data bank 1-6 by the I/O 2-10 is converted and while the data are stored in the registers ΔT1, ΔT2, ΔZ1, ΔZ2, ΔE1 and ΔE2.

(3) Envelope Calculation

The envelope data is read out and stored in the registers ΔZ1, ΔZ2, ΔE1 and ΔE2, while the ER1, ER2, ZR1 and ZR2 are initialized. The envelope is calculated on the basis of those stored data.

The bases of envelope calculation are the time slots 3, 5, 6 and 8 of the addition unit. The envelope of the waveform 1 is calculated in the time slots 3 and 5, while the envelope of the waveform 2 is calculated in the time slots 6 and 8. The Ci in the time slots 5 and 8 is the overflow produced through calculation in the time slots 3 and 6. The addition of the overflow produced in the time slots 5 and 8 is the same as the addition described with regard to address generation in the time slots 13 and 15. The data of ER1 and ER2 thus obtained are the envelope data, which correspond to E1 and E2 shown in FIG. 14. The manner of envelope calculation varies with modes, such as:

(1) Mode in which the wave form does not have PCM part (PCM=1/0), (2) Mode for piano type envelope and organ type envelope (P/O=1/0), and (3) Mode in which damper flag is ON or OFF (DMP=1/0).

These three modes will be described individually hereinafter.

PCM=0 and P/O=0

In the initial state, ER1, ER2, ZR1 and ZR2 are "0". While the key is depressed, the calculation of envelope is executed on the basis of the data of the registers ΔE1, ΔE2, ΔZ1 and ΔZ2. When the key is released, the signal processor 5-6 of the UCIF 2-3 produces release data as the data of ΔZ1, ΔE1, ΔZ2 and ΔE2 in the time slots 3, 5, 6 and 8, and the release data is used instead of the data of the registers ΔZ1, ΔE1, ΔZ2 and ΔE2. In this mode, the calculation is not affected by the damper flag DMP.

PCM=0 and P/O=1

In the initial state, ER1, ER2, ZR1 and ZR2 are "0". While the key is depressed, the calculation of envelope is executed on the basis of the data of the registers ΔE1, ΔE2, ΔZ1 and ΔZ2. When the key is released, the calculation of envelope is continued on the basis of the data of the registers ΔE1, ΔE2, ΔZ1 and ΔZ2 when damper flag DMP=1. The operation when DMP=0 is the same as that when PCM=0 and P/O=0.

PCM=1 and P/O=0

In the initial state, $EA1=1FFF_{16}$, ER2=0, ZR1=0 and ZR2=0. While the key is depressed and the waveform 1 is reading the PCM part, those initial values are held. After completion of reading the PCM part, the calculation of envelope is executed on the basis of the data of the registers ΔE1, ΔE2, ΔZ1 and ΔZ2. When the key is released, the calculation is executed on the release data provided by the signal processor 5-6 of the UCIF 2-3 regardless of whether or not the waveform 1 is reading the PCM part. Thus, the mode of PCM=0 and P/O=0 results. In this mode the calculation is not affected by the damper flag DMP.

PCM=1 and P/O=1

In the initial state, ER1=1FFF16, ER2=0, ZR1=0 and ZR2=0. When the damper flag DMP=0, the calculation is carried out once the key is depressed regardless of the timing of releasing the key. While the wave form 1 is reading the PCM part, the registers ER1, ER2, ZR1 and ZR2 are held in the initial state and upon the completion of reading the PCM part, the operation is started on the basis of the data of the registers ΔE1, ΔE2, ΔZ1 and ΔZ2. When the damper flag DMP=1, the operation is the same as the mode in which PCM=1 and P/O=0.

Thus, envelope signals can be optionally produced according to various modes. Furthermore, since the registers ΔE1, ΔZ1, and the registers ΔE2 and ΔZ2 can be set entirely independently from each other and the data is renewed at a time decided by ΔT1 and ΔT2, those two waveforms and those various modes generates various musical tone signals.

What is claimed is:

1. An electronic musical instrument comprising:

a data bank for storing a first waveform data corresponding to an attack portion and one cycle waveform of a cyclic portion following the attack portion of a first musical tone, a second waveform data corresponding to one cycle waveform of a cyclic portion of a second musical tone, a first parameter data representing a first envelope data corresponding to a sound level variation of the first musical tone, and a second parameter data representing a second envelope data corresponding to a sound level variation of the second musical tone;

envelope forming means which reads out the first and second parameter data from the data bank and forms the first and second envelope data;

first musical tone data producing means which reads out the first waveform data from the data bank, the data corresponding to the one cycle waveform of the first waveform data being read out repeatedly, thereby producing a first continuous waveform data including at the beginning thereof the data corresponding to the attack portion, and multiplies the first continuous waveform data by the first envelope data to produce a first musical tone data including at the beginning thereof the data corresponding to the attack portion;

second musical tone data producing means which reads out the second waveform data repeatedly from the data bank thereby producing a second continuous waveform data, and multiplies the second continuous waveform data by the second envelope data to produce a second musical tone data;

musical tone data producing means which adds the first and second musical tone data to produce a synthesized musical tone data including at the beginning thereof the data corresponding to the attack portion; and means generating a musical tone including an attack portion according to the synthesized musical tone data.

2. An electronic musical instrument according to claim 1, wherein each of the first and second envelope data corresponds to a polygonal line formed by a series of straight lines on a coordinate system defined by a time axis of linear representation and a sound level axis of exponential representation, each of the first and second parameter data having gradients and time lengths of the respective straight lines, and wherein the envelope forming means has means which counts each of the time lengths of the first parameter data and each of the time lengths of the second parameter data, and means which renews the first and second parameter data from the data bank at every end of the respective time lengths in response to the count results of the count means.

3. An electronic musical instrument according to claim 1, further comprising:

a first means for producing note data, octave data and tablet data in response to a playing operation;

a second means for producing a partial differential value (PED);

a third means coupled to the first means for producing a note coefficient (CN) corresponding to the note data;

a fourth means coupled to the second and third means for adding a fixed number (JD) independent of the note data and the octave data to the partial differential value (PED), and multiplying the sum of the fixed number (JD) and the partial differential value (PED) by the note coefficient (CN), thereby producing a dividing number ($FR=(JD+PED)\times CN$); and a fifth means coupled to the fourth means for dividing a master clock signal by the dividing number (FR) thereby producing a note clock signal, the note clock signal being supplied to the first and second musical tone data producing means, whereby the first and second musical tone data producing means respectively read out the first and second waveform data from the data bank on the basis of the note clock signal.

4. An electronic musical instrument according to claim 1, wherein each of the first and second waveform data is composed of N bits divided into upper M bits and lower N-M bits, where $M<N\leqq 3\,M/2$, and wherein the data bank has W words each composed of M bits in an area for each of the first and second waveform data, each of the first and second waveform data being stored in the area in such a way that the upper M bits are stored in the first address A and the lower N-M bits are stored in a second address B, the first and second addresses satisfying the following condition: $B=[W/2+\{(N-M)/M\}\cdot A]$ where the parentheses [ ] are the Gaussian symbol representing the integer part of the value contained within the symbol.

5. An electronic musical instrument according to claim 4, further comprising a means for producing the second address B by shifting the first address A to the right by $\log_2 M/(N-M)$ bits and replacing an uppermost bit by 1 after each one bit shift.

* * * * *